US008000634B2

(12) United States Patent
Sato

(10) Patent No.: US 8,000,634 B2
(45) Date of Patent: Aug. 16, 2011

(54) IMAGE FORMING APPARATUS AND CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 676 days.

(21) Appl. No.: 11/363,165

(22) Filed: Feb. 28, 2006

(65) Prior Publication Data

US 2006/0193658 A1 Aug. 31, 2006

(30) Foreign Application Priority Data

Feb. 28, 2005 (JP) ..... 2005-053070

(51) Int. Cl.
*G03G 15/08* (2006.01)

(52) U.S. Cl. ..... 399/254; 399/255

(58) Field of Classification Search ..... 399/254, 399/255, 258
See application file for complete search history.

(56) References Cited

U.S. PATENT DOCUMENTS

| | | | | |
|---|---|---|---|---|
| 4,839,691 | A | 6/1989 | Tagawa et al. | |
| 5,523,832 | A | 6/1996 | Hamamichi et al. | |
| 5,541,714 | A | 7/1996 | Watanabe et al. | |
| 5,608,501 | A | 3/1997 | Makino | |
| 5,742,882 | A | 4/1998 | Lee | |
| 5,867,756 | A | 2/1999 | Suzuki et al. | |
| 6,127,083 | A | 10/2000 | Nomura et al. | |
| 6,169,865 | B1 * | 1/2001 | Miyabe et al. | 399/111 |
| 6,351,618 | B1 | 2/2002 | Pollocks, Jr. | |
| 6,501,933 | B2 | 12/2002 | Ishii | |
| 6,823,155 | B2 | 11/2004 | Tsuda et al. | |
| 7,252,918 | B2 | 8/2007 | Nakamura et al. | |
| 7,272,336 | B1 | 9/2007 | Dawson et al. | |
| 7,321,739 | B1 | 1/2008 | Dawson et al. | |
| 2001/0041079 | A1 | 11/2001 | Michlin et al. | |
| 2003/0156848 | A1 | 8/2003 | Kawai et al. | |
| 2004/0131382 | A1 | 7/2004 | Kikuchi et al. | |
| 2006/0177241 | A1 | 8/2006 | Sato et al. | |

(Continued)

FOREIGN PATENT DOCUMENTS

CN 1167280 A 12/1997

(Continued)

OTHER PUBLICATIONS

European Patent Office, European Search Report (corresponding European Patent Appl'n No. 06 00 3846) dated Nov. 22, 2007.

(Continued)

*Primary Examiner* — David M Gray
*Assistant Examiner* — Erika Villaluna
(74) *Attorney, Agent, or Firm* — Baker Botts L.L.P.

(57) ABSTRACT

An image forming apparatus includes: an electrostatic latent image bearing member; a toner cartridge; a developing member; a transfer member; a developing device; a toner-circulating member; a drive-force output unit; and a circulating-member driving unit. The toner cartridge is removably coupled to the developing device. The toner-circulating member is incorporated in the developing device and circulates toner between the developing device and the toner cartridge. The drive-force output unit is provided in the toner cartridge and is configured to output to the developing device a drive force for driving the toner-circulating member. The circulating-member driving unit is provided in the developing device and is configured to drive the toner-circulating member upon receiving the drive force outputted from the drive-force output unit while the toner cartridge is being coupled to the developing device.

23 Claims, 18 Drawing Sheets

U.S. PATENT DOCUMENTS

| | | | |
|---|---|---|---|
| 2006/0193652 | A1 | 8/2006 | Sato |
| 2006/0193658 | A1 | 8/2006 | Sato |

FOREIGN PATENT DOCUMENTS

| | | | | |
|---|---|---|---|---|
| CN | 1201533 | A | | 12/1998 |
| DE | 4223147 | A1 | | 1/1993 |
| EP | 0670530 | A2 | | 9/1995 |
| EP | 0670530 | A3 | | 9/1995 |
| EP | 0770931 | A2 | | 5/1997 |
| JP | H01-193877 | A | | 8/1989 |
| JP | H03-180875 | A | | 8/1991 |
| JP | 03204667 | A | * | 9/1991 |
| JP | H04-031884 | A | | 2/1992 |
| JP | H06-019306 | A | | 1/1994 |
| JP | 6102765 | | | 4/1994 |
| JP | H06-222668 | A | | 8/1994 |
| JP | H07-113805 | B2 | | 12/1995 |
| JP | H09-090733 | A | | 4/1997 |
| JP | H09-211948 | A | | 8/1997 |
| JP | H9222796 | A | | 8/1997 |
| JP | 9319201 | | | 12/1997 |
| JP | H09-319214 | A | | 12/1997 |
| JP | 2000187382 | A | | 2/1999 |
| JP | 11133711 | | | 5/1999 |
| JP | H11-218957 | A | | 8/1999 |
| JP | H11-305629 | A | | 11/1999 |
| JP | H11-327288 | A | | 11/1999 |
| JP | 3044997 | | | 3/2000 |
| JP | 2000-098727 | A | | 4/2000 |
| JP | 2000-122423 | A | | 4/2000 |
| JP | 2000-187431 | A | | 7/2000 |
| JP | 2000-267420 | A | | 9/2000 |
| JP | 2001092256 | A | | 4/2001 |
| JP | 2002040783 | A | | 2/2002 |
| JP | 2002-156891 | A | | 5/2002 |
| JP | 2002-169365 | A | | 6/2002 |
| JP | 2002 244533 | | | 8/2002 |
| JP | 2002-258693 | A | | 9/2002 |
| JP | 2002-287473 | A | | 10/2002 |
| JP | 2003-186369 | A | | 7/2003 |
| JP | 2004-012652 | A | | 1/2004 |
| JP | 3595798 | B2 | | 12/2004 |
| JP | H10-274881 | A | | 1/2008 |

OTHER PUBLICATIONS

Chinese Office Action received on Apr. 25, 2008, in corresponding Chinese Patent Application No. 200610055016.8.

Japanese Office Action received on May 27, 2008 in corresponding Japanese Patent Application Pub. No. JP 2005-053070.

European Patent Office, Extended European Search Report for European Patent Application No. 06003853.6 (counterpart to the corresponding US Patent Application Publication No. 20060193652 A1 ), dated Jan. 18, 2008.

Patent Office of The People's Republic of China, First Office Action for Chinese Patent Application No. 2006100550153 (counterpart to the corresponding US Patent Application Publication No. 20060177241 A1), mailed Jun. 27, 2008.

Japanese Patent Office, Office Action for Japanese Patent Application No. 2005-053796 (counterpart to the corresponding US Patent Application Publication No. 20060177241 A1 ), mailed May 27, 2008.

Japanese Patent Office, Office Action for Japanese Patent Application No. 2005-208443 (counterpart to the corresponding US Patent Application Publication No. 20060177241 A1 ), mailed Oct. 14, 2008.

United States Patent and Trademark Office, Office Action for copending U.S. Appl. No. 11/363,161, dated Nov. 10, 2010.

* cited by examiner

IMAGE FORMING APPARATUS AND CARTRIDGE

CROSS REFERENCE TO RELATED APPLICATION

This application claims priority from Japanese Patent Application No. 2005-53070 filed Feb. 28, 2005, the entire content of which is hereby incorporated by reference.

TECHNICAL FIELD

The disclosure relates to an image forming apparatus of an electronic photographic type, in which an electrostatic latent image formed on an electrostatic latent image bearing body is developed into a toner image, and the toner image is transferred to a recording medium, and to a cartridge that can be used in the image forming apparatus.

BACKGROUND

There has been proposed an image forming apparatus of a type that includes: an electrostatic latent image bearing body having an electrostatic latent image formed thereon; a toner cartridge containing toner; a developing member for supplying toner from the toner cartridge to the electrostatic latent image bearing body, thereby developing the electrostatic latent image into a toner image; a transfer member for transferring the toner image from the electrostatic latent image bearing body to a recording medium; and a developing device which incorporates at least the developing member and in which the toner cartridge is removably provided.

In the image forming apparatus of this type, after an electrostatic latent image is formed on the electrostatic latent image bearing body, the developing member supplies the toner from the toner cartridge onto the electrostatic latent image bearing body, thereby developing the latent image. Then, the transfer member transfers the toner image from the electrostatic latent image bearing body to a recording medium. As a result, an image corresponding to the electrostatic latent image is formed on the recording medium.

Since the toner cartridge can be removed from the developing device that incorporates the developing member, the toner cartridge can be replaced by a new one when toner is consumed up, thereby continuing image forming.

SUMMARY

It is desirable to ensure that some components in the developing device will not operate while the toner cartridge remains disconnected from the developing device.

U.S. Pat. No. 5,867,756 has proposed an image forming apparatus of this type, in which toner-circulating members, such as auger rollers, are provided in the housing to circulate toner between the developing device and the toner cartridge. This prevents toner from accumulating or coagulating at a particular position. Sufficient fluidity of toner can be ensured.

In this type of developing device provided with the toner-circulating members, however, if the toner-circulating members are erroneously driven while the toner cartridge remains removed from the developing device, the pressure on the toner in the developing device will rise, and consequently, the toner will overflow through a gap formed in the developing device. It is therefore desirable to ensure that the toner-circulating members will not operate while the toner cartridge remains disconnected from the developing device.

In view of the foregoing, an object of the invention is to provide an image forming apparatus that has a developing device and a toner cartridge and that can ensure that at least one component in the developing device will not operate while the toner cartridge remains disconnected from the developing device, and to provide the toner cartridge.

Another object of the invention is to provide a development cartridge and a process cartridge that can ensure that at least one component in the cartridge will not operate while the toner cartridge remains disconnected from the cartridge.

In order to attain the above and other objects, the invention provides an image forming apparatus, including: an electrostatic latent image bearing member; a toner cartridge; a developing member; a transfer member; a developing device; a toner-circulating member; a drive-force output unit; and a circulating-member driving unit. The electrostatic latent image bearing member has an electrostatic latent image formed thereon. The toner cartridge contains toner. The developing member supplies the toner from the toner cartridge onto the electrostatic latent image bearing member, thereby developing the electrostatic latent image into a toner image. The transfer member transfers the toner image from the electrostatic latent image bearing member to a recording medium. The toner cartridge is removably coupled to the developing device. The developing device incorporates the developing member. The toner-circulating member is incorporated in the developing device and circulates toner between the developing device and the toner cartridge. The drive-force output unit is provided in the toner cartridge and is configured to output to the developing device a drive force for driving the toner-circulating member. The circulating-member driving unit is provided in the developing device and is configured to drive the toner-circulating member upon receiving the drive force outputted from the drive-force output unit while the toner cartridge is being coupled to the developing device.

According to another aspect, the invention provides a toner cartridge, which is capable of being removably coupled to a development cartridge that includes a developing member, the toner cartridge including: a casing defining a toner containing portion that contains toner; a drive-force input unit to which a drive force is inputted; and a drive-force output unit that is configured to output the drive force.

According to another aspect, the invention provides a development cartridge which is capable of being detachably mounted in an image forming apparatus, the development cartridge including: a casing; a developing member that is mounted in the casing and that supplies toner from a toner cartridge to an electrostatic latent image bearing member, on which an electrostatic latent image is formed, thereby developing the electrostatic latent image into a toner image; a toner-circulating member that circulates toner; and a circulating-member driving unit that is configured to drive the toner-circulating member upon receiving a drive force from the toner cartridge.

According to another aspect, the invention provides a process cartridge which is capable of being detachably mounted in an image forming apparatus, the process cartridge including: a casing; an electrostatic latent image bearing member provided in the casing, an electrostatic latent image being formed on the electrostatic latent image bearing member; a developing member that is mounted in the casing and that supplies toner from the toner cartridge to the electrostatic latent image bearing member, thereby developing the electrostatic latent image formed on the electrostatic latent image bearing member into a toner image; a toner-circulating member that circulates toner; and a circulating-member driving unit that is configured to drive the toner-circulating member upon receiving a drive force transmitted from the toner cartridge.

According to another aspect, the invention provides an image forming apparatus, including: an electrostatic latent image bearing member; a toner cartridge; a developing member; a transfer member; a developing device; and a drive-force output unit. The electrostatic latent image bearing member has an electrostatic latent image formed thereon. The toner cartridge contains toner. The developing member supplies the toner from the toner cartridge onto the electrostatic latent image bearing member, thereby developing the electrostatic latent image into a toner image. The transfer member transfers the toner image from the electrostatic latent image bearing member to a recording medium. The toner cartridge is removably coupled to the developing device. The developing device incorporates the developing member. The drive-force output unit is provided in the toner cartridge and is configured to output a drive force to the developing device while the toner cartridge is being coupled to the developing device.

According to another aspect, the invention provides a development cartridge which is capable of being detachably mounted in an image forming apparatus, the development cartridge including: a casing; a developing member that is mounted in the casing and that supplies toner from a toner cartridge to an electrostatic latent image bearing member, on which an electrostatic latent image is formed, thereby developing the electrostatic latent image into a toner image; and a drive-force receiving unit that is configured to receive a drive force from the toner cartridge while the toner cartridge is being coupled to the casing.

According to another aspect, the invention provides a process cartridge which is capable of being detachably mounted in an image forming apparatus, the process cartridge including: a casing; an electrostatic latent image bearing member provided in the casing, an electrostatic latent image being formed on the electrostatic latent image bearing member; a developing member that is mounted in the casing and that supplies toner from a toner cartridge to the electrostatic latent image bearing member, thereby developing the electrostatic latent image formed on the electrostatic latent image bearing member into a toner image; and a drive-force receiving unit that is configured to receive a drive force transmitted from the toner cartridge while the toner cartridge is being coupled to the casing.

BRIEF DESCRIPTION OF THE DRAWINGS

Illustrative aspects in accordance with the invention will be described in detail with reference to the following figures wherein.

DETAILED DESCRIPTION

Figure 1:
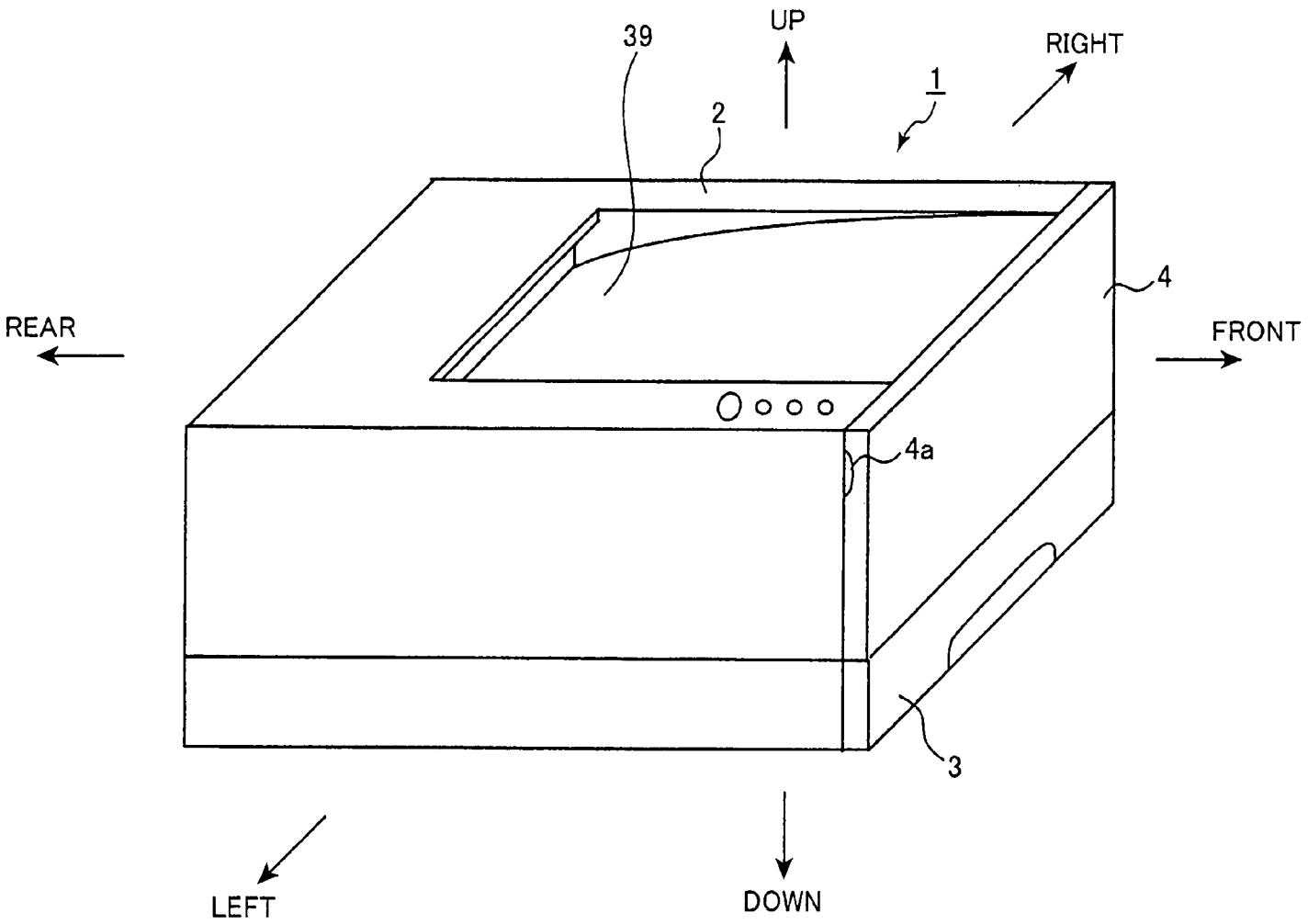
FIG. 1 is a perspective view of a laser printer according to an illustrative aspect of the invention.

An image forming apparatus according to some aspects of the invention will be described while referring to the accompanying drawings wherein like parts and components are designated by the same reference numerals to avoid duplicating description.

FIG. 1 is a perspective view representing the outer appearance of a laser printer 1 according to this aspect.

The terms "upward", "downward", "upper", "lower", "above", "below", "beneath", "left", "right" and the like will be used throughout the description assuming that the laser printer 1 is disposed in an orientation in which it is intended to be used. In use, the laser printer 1 is disposed as shown in FIG. 1. The left-and-right direction defined in the laser printer 1 is equivalent to the widthwise direction of a sheet of paper that is conveyed in the laser printer 1.

As shown in FIG. 1, a cover 2 is provided covering the outer periphery of the main body of the laser printer 1. A sheet cassette 3 is mounted below the cover 2.

Figure 2:
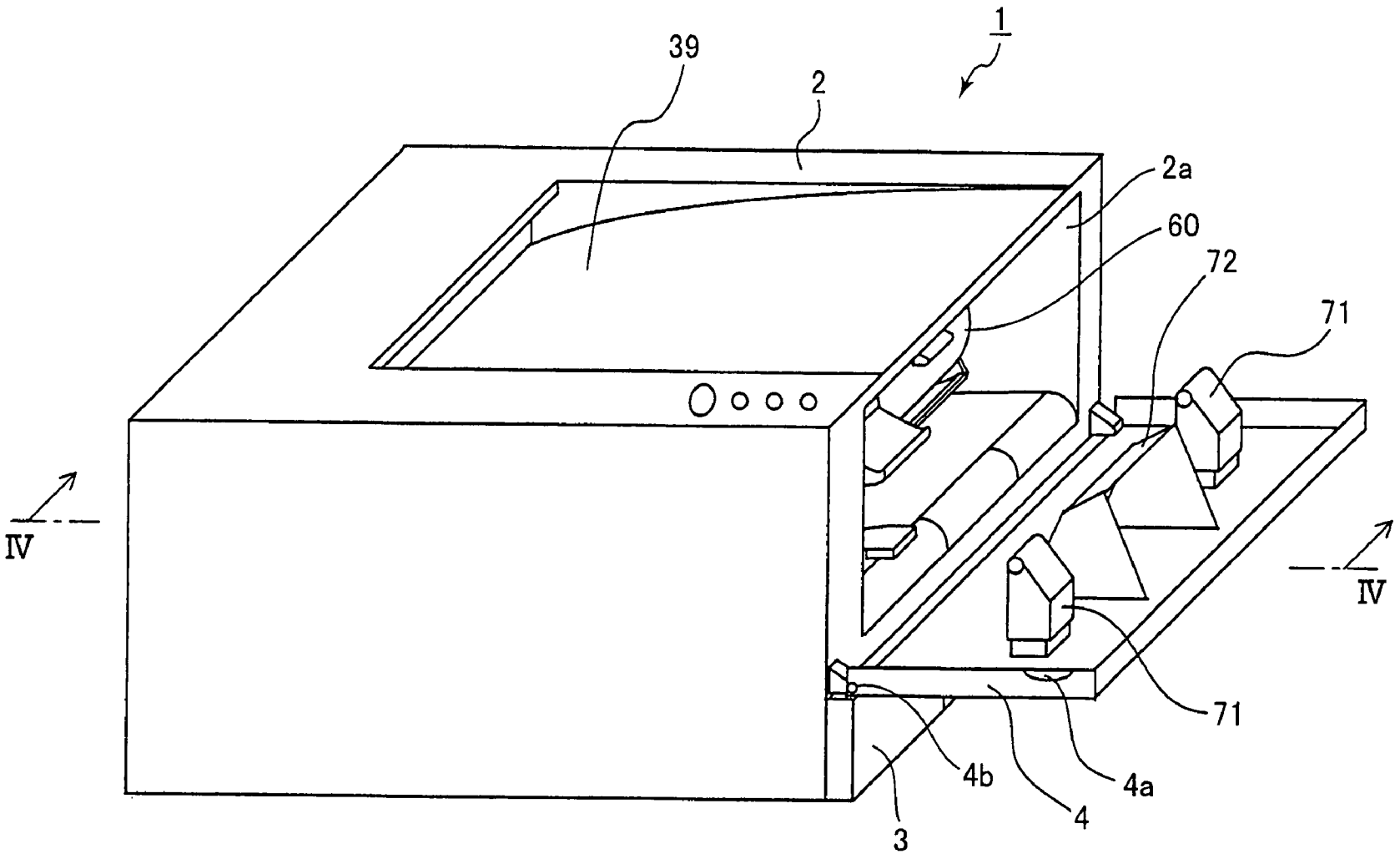
FIG. 2 is a perspective view of the laser printer, illustrating how a lid of the laser printer is opened.

As shown in FIG. 2, the cover 2 defines an opening 2*a* at its front side, and has a lid 4 that can open and close the opening 2*a*. Usually, the lid 4 closes the opening 2*a* as shown in FIG. 1.

The lid 4 has finger rests 4*a* on the upper left and right sides, respectively. The user may hold the lid 4, placing his or her fingers in the finger rests 4*a*, and then pull the lid 4. As a result, as shown in FIG. 2, the lid 4 rotates around a hinge 4*b*, that is located at the lower edge of the lid 4, and opens the opening 2*a*.

Figure 3:
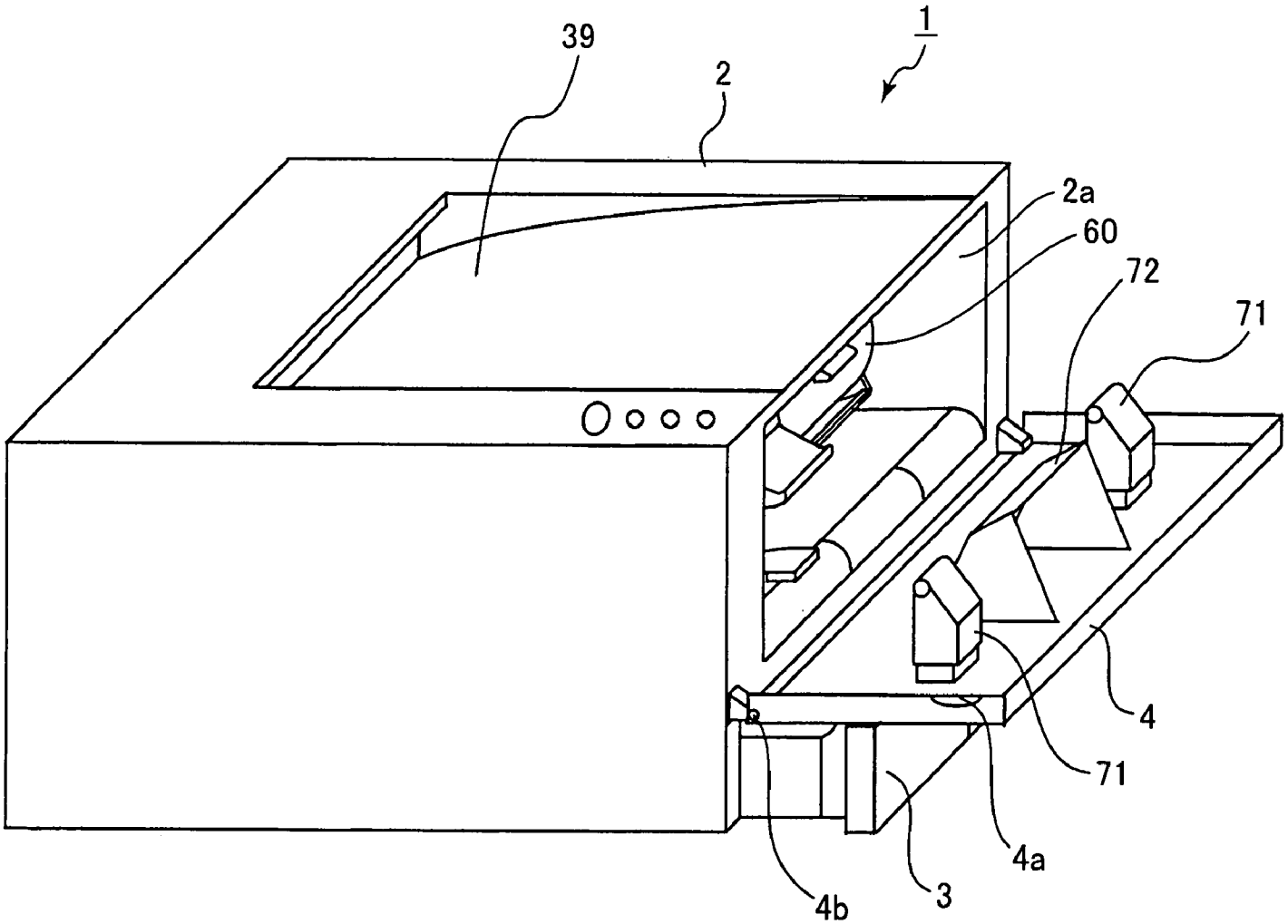
FIG. 3 is a perspective view of the laser printer, illustrating how a sheet cassette is pulled out of the main body of the laser printer.

As shown in FIG. 3, the sheet cassette 3 can be pulled out forwardly from the main body of the laser printer 1. Thus, the sheet cassette 3 can be removed from the main body of the laser printer 1.

Figure 4:
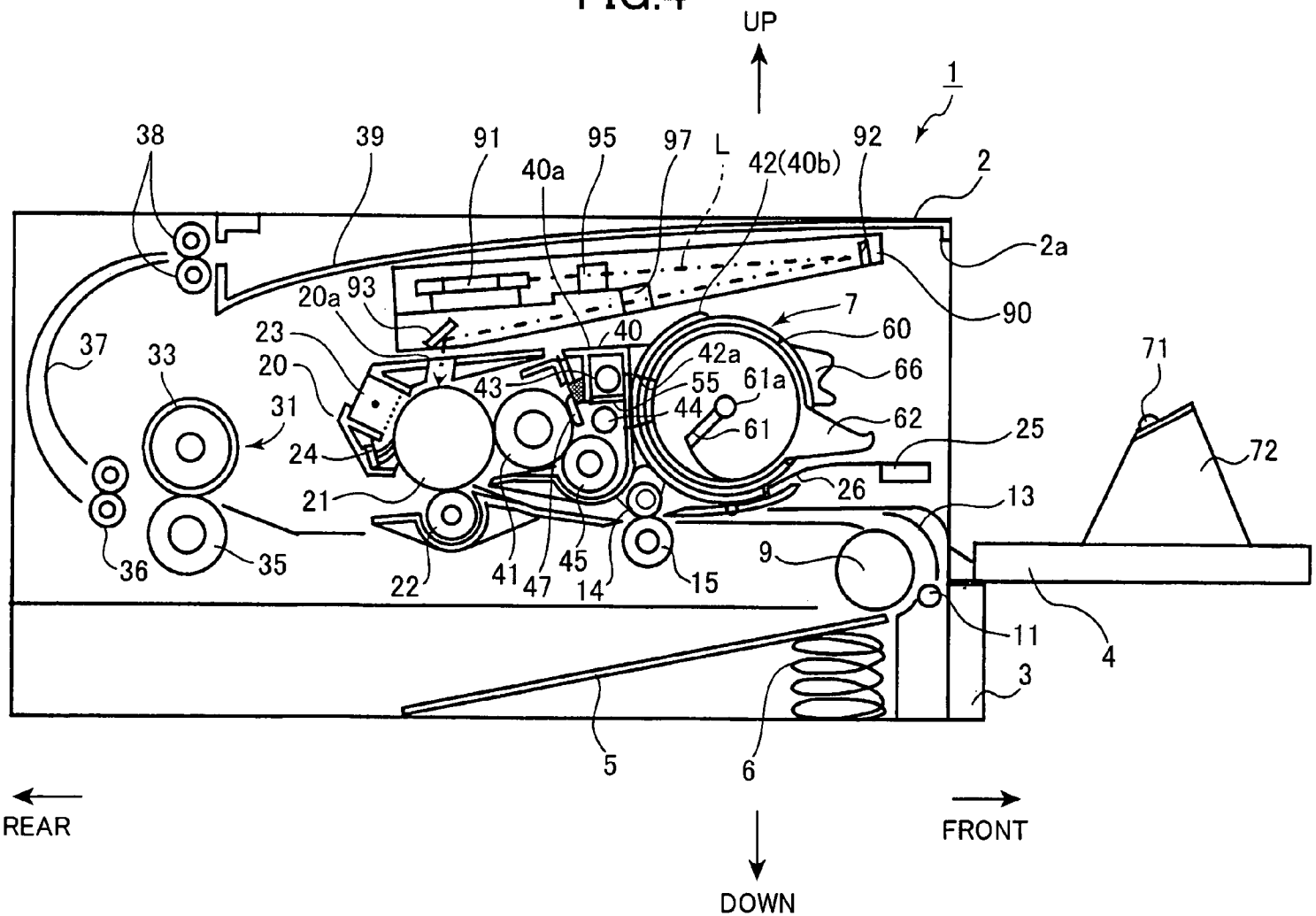
FIG. 4 is a sectional view of the laser printer, taken along a line IV-IV in FIG. 2, showing the internal structure thereof.

As shown in FIG. 4, a spring 6 and a support plate 5 are mounted in the sheet cassette 3. The spring urges the support plate 5 upwardly. A sheet-feeding roller 9 is provided above the front edge of the support plate 5. The sheet-feeding roller 9 is for feeding, one at a time, paper sheets (not shown) that are stuck on the support plate 5 toward an image forming unit 7. Along a sheet conveying path from the sheet-feeding roller 9 to the image forming unit 7, a transport roller 11, a guide 13, and a pair of registration rollers 14 and 15 are arranged in this order. The transport roller 11 cooperates with the sheet-feeding roller 9 to transport paper sheets. The guide 13 receives a paper sheet transported by the transport roller 11 and turns back the sheet by about 180° along the outer circumference of the transport roller 11. The registration rollers 14 and 15 stop rotating at appropriate timings to catch the leading edge of a paper sheet and eliminate a skew of the paper sheet.

The image forming unit 7 includes a photosensitive drum 21 and a transfer roller 22. The photosensitive drum 21 and the transfer roller 22 are mounted in a photosensitive-drum cartridge 20. The transfer roller 22 is opposed to the photosensitive drum 21. A toner image is formed on a paper sheet as the sheet passes through the nip between the photosensitive drum 21 and the transfer roller 22. The paper sheet is then supplied to a fixing unit 31.

In the fixing unit 31, the toner image on the sheet is fixed as the sheet passes through the nip between a heating roller 33 and a pressing roller 35. The sheet, on which the image is now fixed, is transported by a pair of transport rollers 36.

A guide 37 is provided to guide the paper sheet that has been transported by the rollers 36, toward the top of the cover 2. A pair of sheet-discharging rollers 38 discharge the paper sheet onto a sheet tray 39 that is provided on the upper surface of the cover 2.

A scanner unit 90 is provided between the sheet tray 39 and the photosensitive-drum cartridge 20. The scanner unit 90 is for scanning the photosensitive drum 21 with a laser beam L.

Next, the image forming unit 7 and the scanner unit 90 will be described in more detail.

The photosensitive drum 21 is rotatably supported in the photosensitive-drum cartridge 20. The photosensitive drum 21 has a photosensitive layer on the circumferential surface thereof. The transfer roller 22, a scorotron charger 23, and a paper-dust recovering brush 24 are also mounted in the photosensitive-drum cartridge 20. The scorotron charger 23 is for electrically charging the surface of the photosensitive drum 21 uniformly. The photosensitive-drum cartridge 20 is formed with an exposure opening 20*a*. The laser beam L emitted from the scanner unit 90 enters the photosensitive-drum cartridge 20 through the exposure opening 20*a*. The laser beam L forms an electrostatic latent image on the photosensitive drum 21.

A leaf spring 26 is provided on the photosensitive-drum cartridge 20 to hold a development cartridge 40 on the photosensitive drum cartridge 20,. A handle 25 is provided on the front free end of the leaf spring 26. The development cartridge 40 is detachably mounted on the photosensitive drum cartridge 20. A developing roller 41 is rotatably mounted in the development cartridge 40. The developing roller 41 supplies toner onto the surface of the photosensitive drum 21, thereby developing the electrostatic latent image into a toner image on the photosensitive drum 21. The toner image is then transferred from the photosensitive drum 21 onto the paper sheet when the paper sheet is passing through the nip between the photosensitive drum 21 and the transfer roller 22.

The paper-dust recovering brush 24 is in abutment contact with the surface of the photosensitive drum 21 at its location downstream, in the rotating direction of the photosensitive drum 21, from the location where the toner image is transferred from the photosensitive drum 21 to the paper sheet. The brush 24 is applied with a positive bias, and removes negatively-charged paper dust from the photosensitive drum 21.

As shown in FIG. 4, the developing roller 41 is rotatably supported in the development cartridge 40. The developing roller 41 is driven by a mechanism (later described), while in contact with the photosensitive drum 21.

More specifically, the development cartridge 40 has a developing section 40*a* and a toner-cartridge holding section 40*b*. In the developing section 40*a*, the developing roller 41, an upper auger roller 43, a lower auger roller 44, a toner-supplying roller 45, and a developing blade 47 are mounted in the development cartridge 40.

The development cartridge 40 has a toner-cartridge holder 42 in the toner-cartridge holding section 40*b*.

Figure 7:
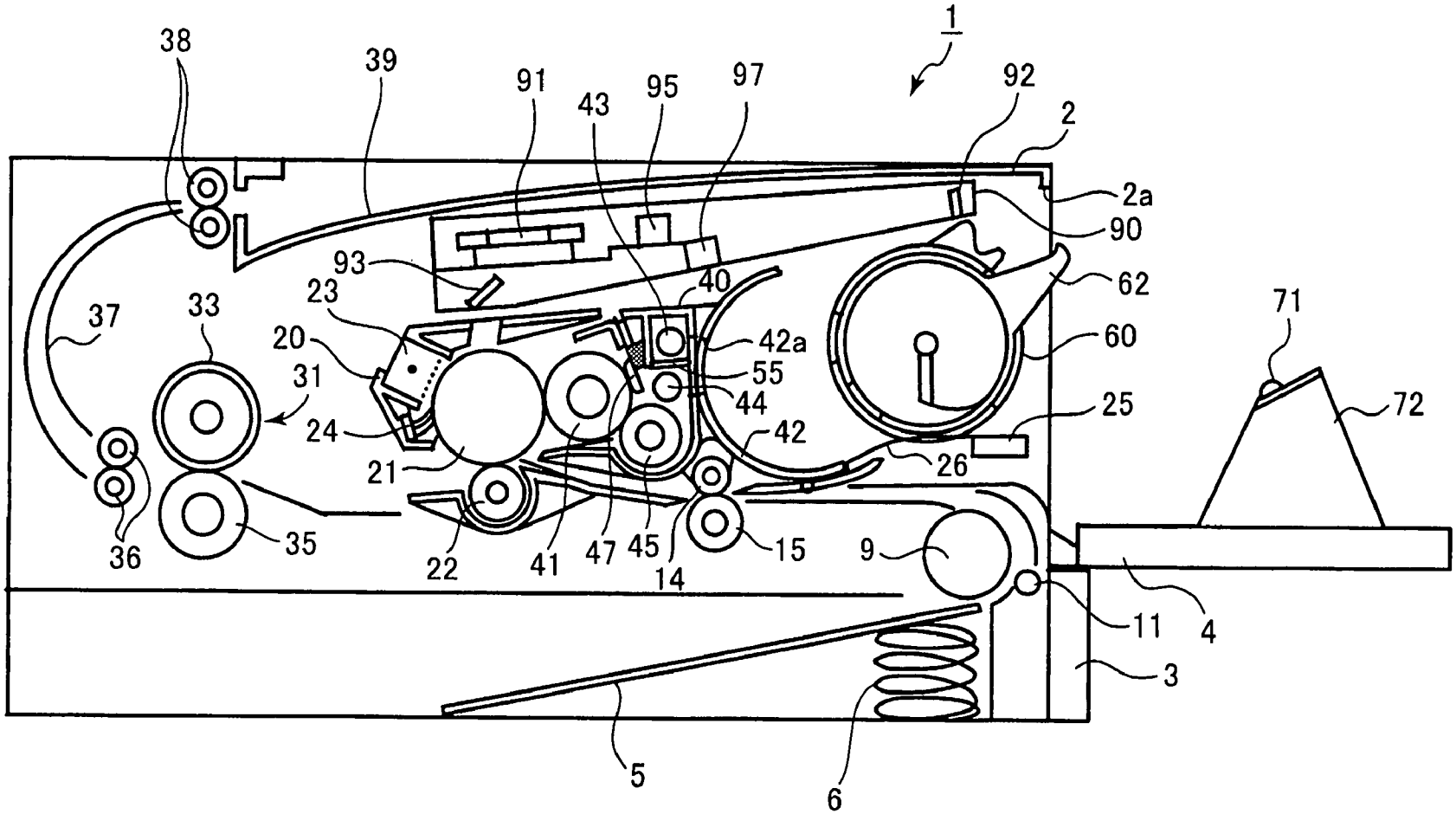
FIG. 7 is a sectional view of the laser printer, illustrating how only the toner cartridge is removed from the main body of the laser printer.

The toner-cartridge holder 42 is of a hollow cylindrical shape that has a peripheral side wall and a pair of end walls (right-side and left-side end walls), with the front parts of the peripheral side wall and the end walls being opened. The toner-cartridge holder 42 is for detachably supporting a toner cartridge 60 on its inner surface, with the front side of the toner cartridge 60 being exposed. The toner-cartridge holder 42 is formed with an opening 42*a* as shown in FIG. 7. Toner is supplied through the opening 42*a* from the toner cartridge 60 into the developing section 40*a*.

Figure 14:
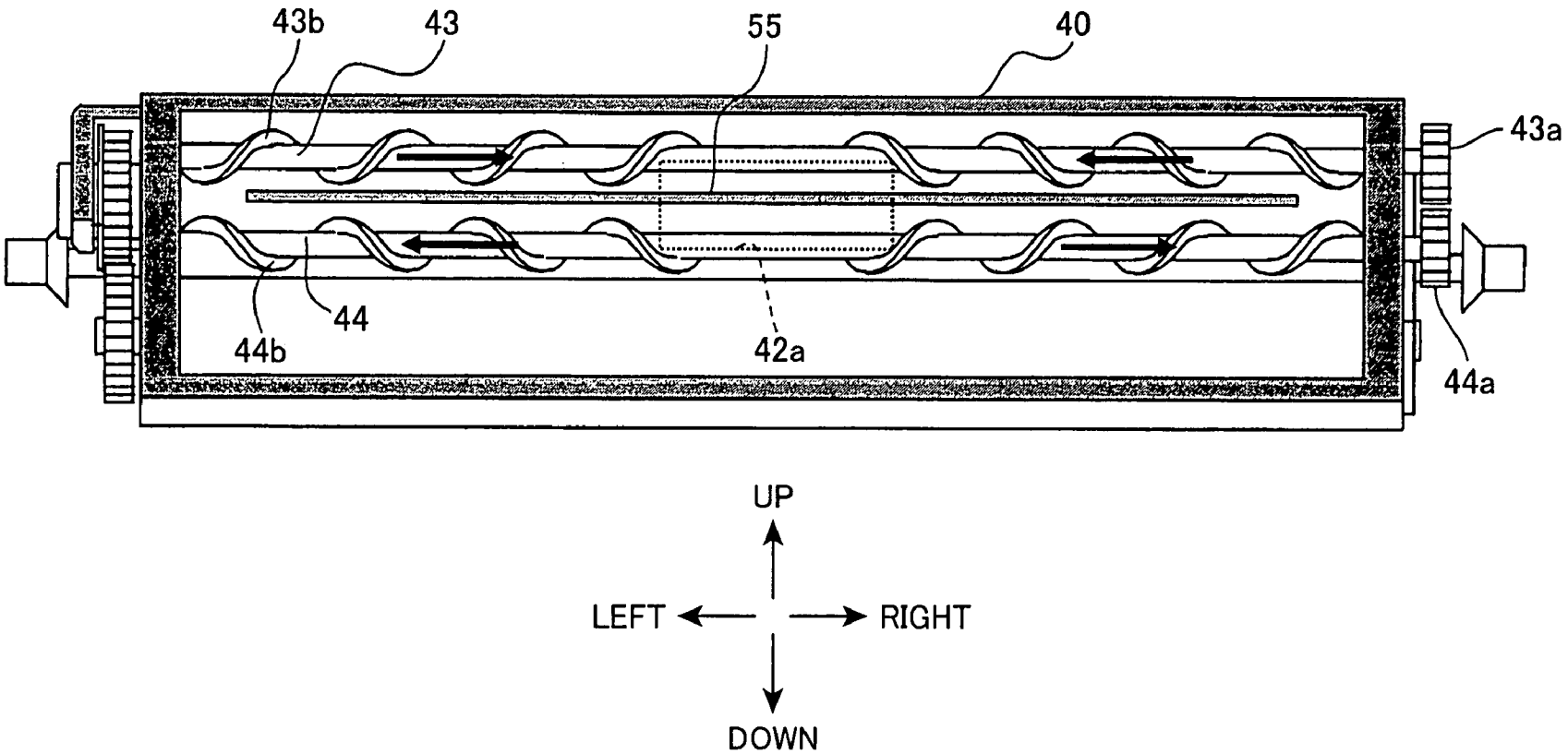
FIG. 14 is a cross-sectional view of the development cartridge, taken along a line in which auger rollers are arranged.

As shown in FIG. 14, the auger rollers 43 and 44 are for receiving toner from the toner cartridge 60 through the opening 42*a*, which confronts the axial middle parts of the auger rollers 43 and 44,. The auger rollers 43 and 44 circulate toner along the axial directions thereof between the left and right side ends thereof.

The toner-supplying roller 45 is for receiving toner from the upper and lower auger rollers 43 and 44 and for supplying toner to the developing roller 41. The developing blade 47 is for electrically charging by friction toner that is supplied from the toner-supplying roller 45 onto the surface of the developing roller 41 and for forming a thin layer of toner on the developing roller 41.

An agitator 61 is rotatably supported in the toner cartridge 60. The agitator 61 rotates around its rotational shaft 61*a* to stir the toner in the toner cartridge 60 to supply the toner to the development cartridge 40.

The scanner unit 90 will be described below.

The scanner unit 90 includes a polygon mirror 91, two mirrors 92 and 93, an fθ lens 95, and a cylindrical lens 97. The polygon mirror 91 deflects and scans the laser beam L that is emitted from a laser emitting unit (not shown). The mirrors 92 and 93 reflect the laser beam L, guiding the beam L to the photosensitive drum 21. The fθ lens 95 is located on an optical path that extends from the polygon mirror 91 to the mirror 92. A cylindrical lens 97 is located on another optical path that extends from the mirror 92 to the mirror 93.

The laser unit (not shown) intermittently emits a laser beam L at appropriate timings, while the polygon mirror 91 and the photosensitive drum 21 are being rotated. As a result, an electrostatic latent image is formed on the surface of the photosensitive drum 21. The developing roller 41 supplies toner to the photosensitive drum 21, thereby developing the electrostatic latent image into a toner image. The toner image is then transferred from the photosensitive drum 21 onto a paper sheet. Thus, an image is formed on the paper sheet according to an electronic photography method.

Figure 5:
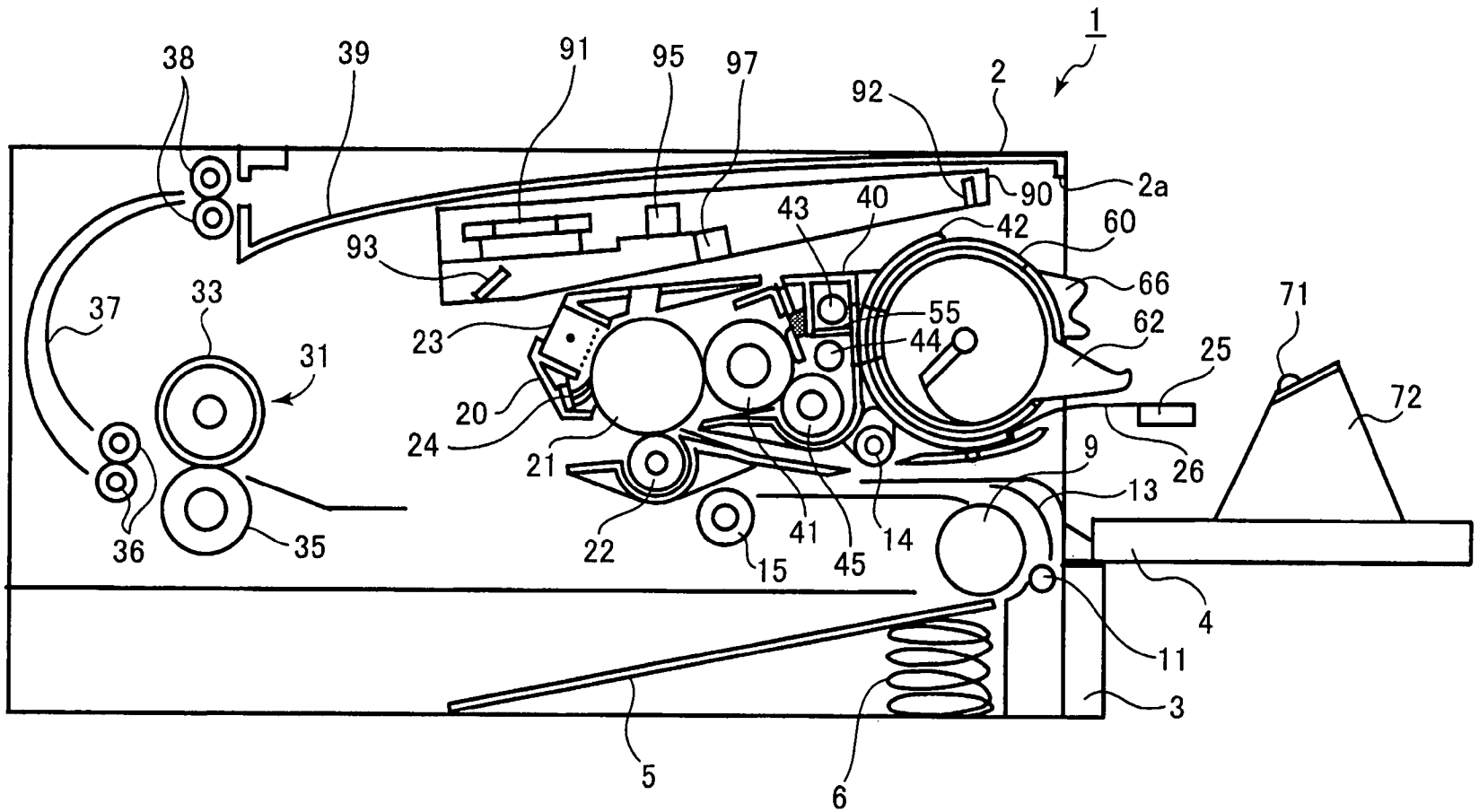
FIG. 5 is a sectional view of the laser printer, illustrating how a photosensitive-drum cartridge, a development cartridge, and a toner cartridge are removed, as an integral unit, from the main body of the laser printer.

As shown in FIG. 5, when the user opens the lid 4 and pulls the handle 25 provided on the photosensitive-drum cartridge 20, the photosensitive-drum cartridge 20 is removed from the main body of the laser printer 1, together with the development cartridge 40 and the toner cartridge 60, through the opening 2*a*.

The toner cartridge 60 has a handle 62. When the user rotates the handle 62 upwards to a disconnecting position shown in FIG. 6, the toner cartridge 60 is disconnected from the development cartridge 40 in a manner described later. The user then pulls the handle 62, whereby only the toner cartridge 60 is removed from the main body of the laser printer 1 through the opening 2*a*, as is illustrated in FIG. 7.

Figure 8:
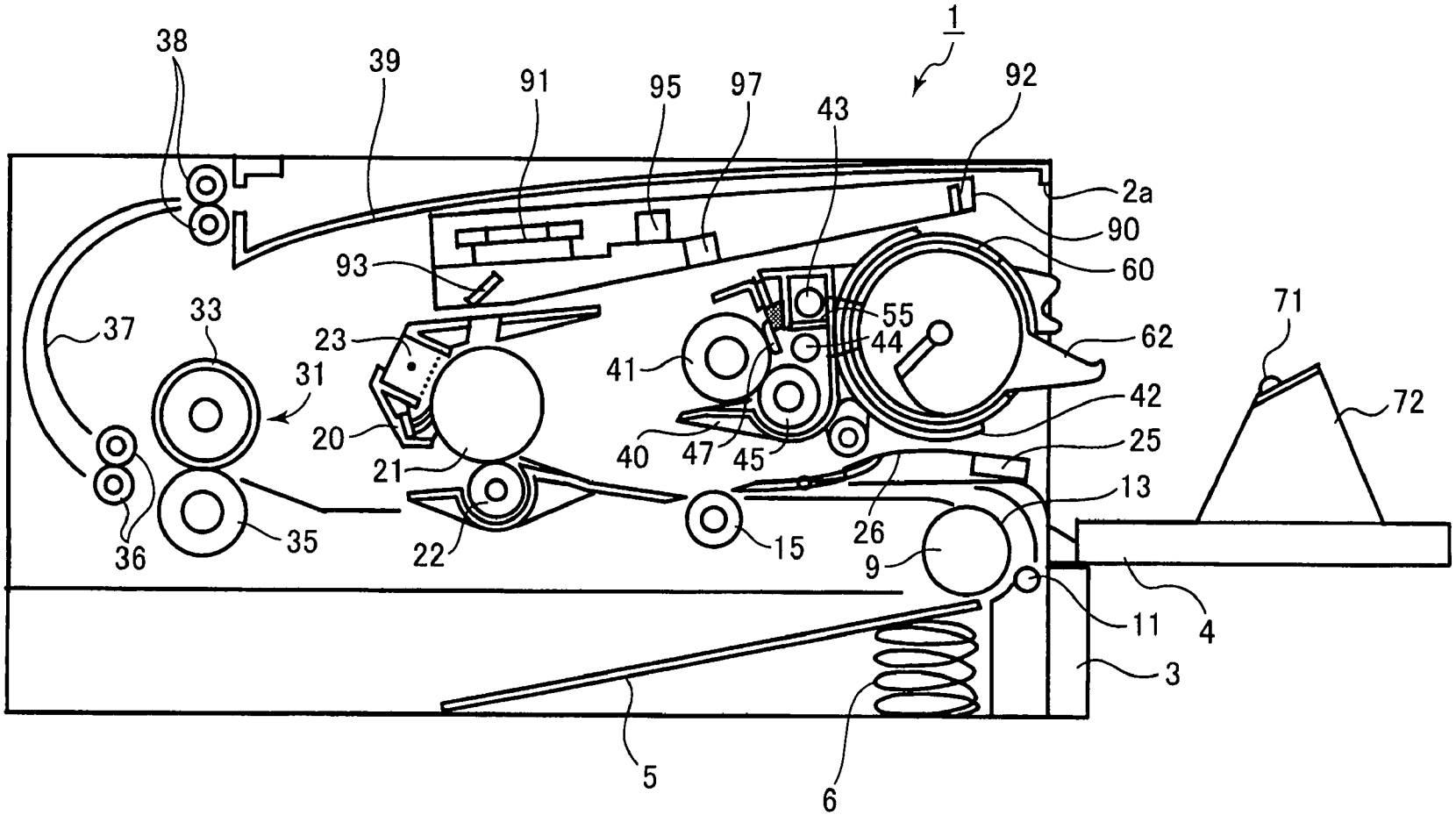
FIG. 8 is a sectional view of the laser printer, illustrating how the development cartridge and the toner cartridge are removed, as an integral unit, from the main body of the laser printer.

As shown in FIG. 8, when the user pushes down the handle 25 on the photosensitive-drum cartridge 20, the leaf spring 26 is pushed down. The user then pulls the handle 62 forwardly without rotating the handle 62 upwards. In this case, the toner cartridge 60 and the development cartridge 40 are detached together, as an integral unit, from the photosensitive-drum cartridge 20 as shown in FIG. 8, and are removed from the main body of the laser printer 1 through the opening 2*a*.

Next, the respective components in the image forming unit 7 will be described in detail.

Figure 9:
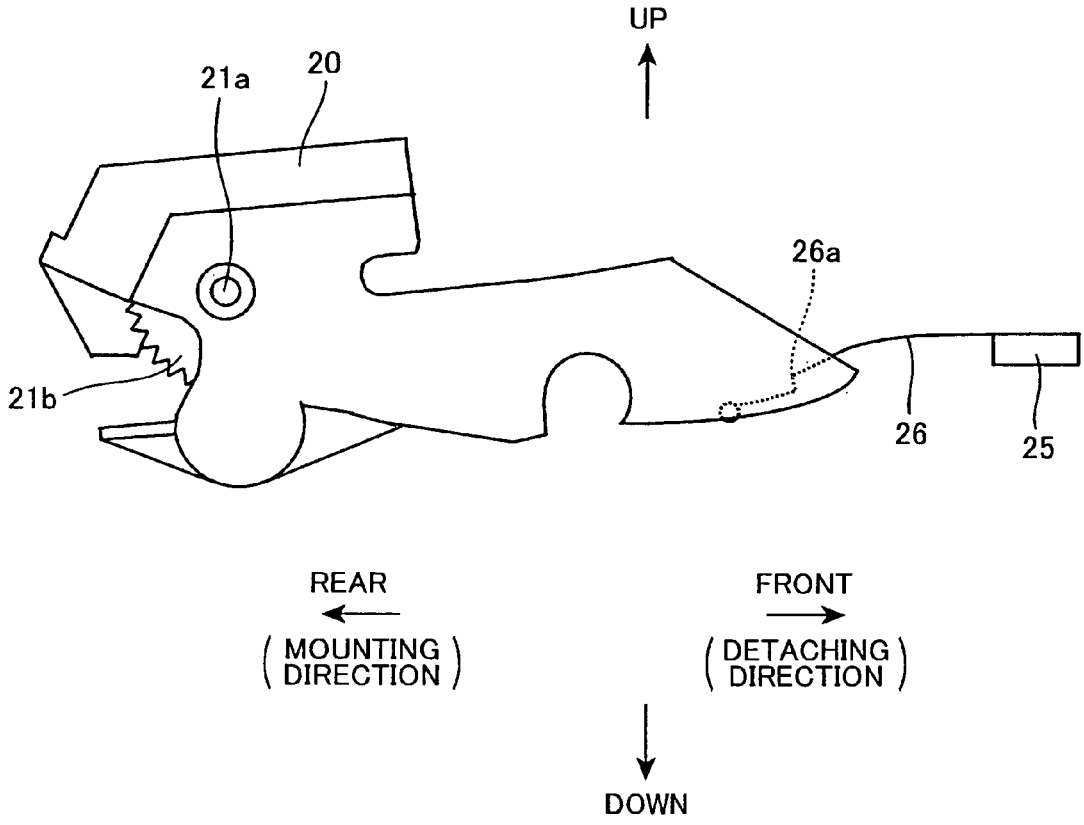
FIG. 9 is a left-side view of the photosensitive-drum cartridge, from which the development cartridge and the toner cartridge are removed.

As described above, the handle 25 is fixedly secured to the photosensitive-drum cartridge 20 via the leaf spring 26. As shown in FIG. 9, the leaf spring 26 is bent upwardly at its midpoint, providing a bent part 26*a* that is shaped like a step. When the development cartridge 40 is mounted on the photosensitive-drum cartridge 20 as shown in FIG. 4, the bent part 26*a* comes into engagement with the lower edge of the toner-cartridge holder 42, as a result of which the development cartridge 40 is coupled to the photosensitive-drum cartridge 20. When the handle 25 is pushed down as described above (see FIG. 8), the bent part 26*a* disengages from the lower edge of the toner-cartridge holder 42. Hence, the development cartridge 40 can be coupled to, and disconnected from, the photosensitive-drum cartridge 20.

As shown in FIG. 9, the photosensitive drum 21 has a metal rotational shaft 21*a*, which projects outwardly from both of the left and right sides of the photosensitive-drum cartridge 20. A gear 21*b* is provided on the left-side end of the photosensitive drum 21. The gear 21*b* rotates integrally with the photosensitive drum 21. The gear 21*b* protrudes from the rear end of the photosensitive-drum cartridge 20.

Figure 10:
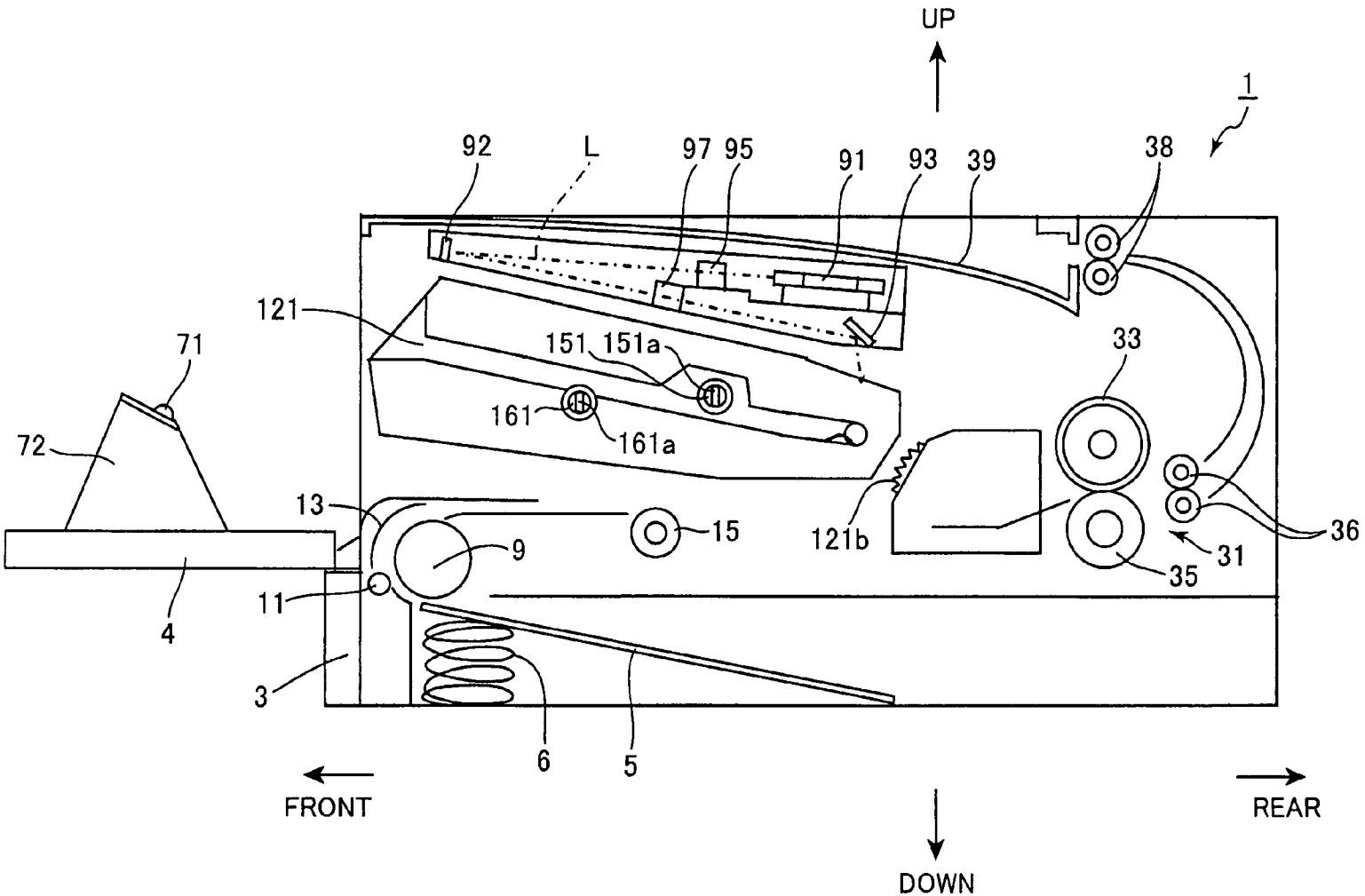
FIG. 10 shows the configuration on the inner surface of a left-side wall in the main body of the laser printer.

As shown in FIG. 10, a guide groove 121 is formed on the inner surface of the left-side wall in the main body of the laser printer 1. The guide groove 121 is for guiding the rotational shaft 21*a* of the photosensitive drum 21. A gear 121*b* is provided in the main body of the laser printer 1. When the photosensitive-drum cartridge 20 is set in position in the main body of the laser printer 1, the gear 121*b* is in engagement with the gear 21*b*. Accordingly, a drive force is transmitted from the main body of the laser printer 1 to the photosensitive drum 21.

Figure 11:
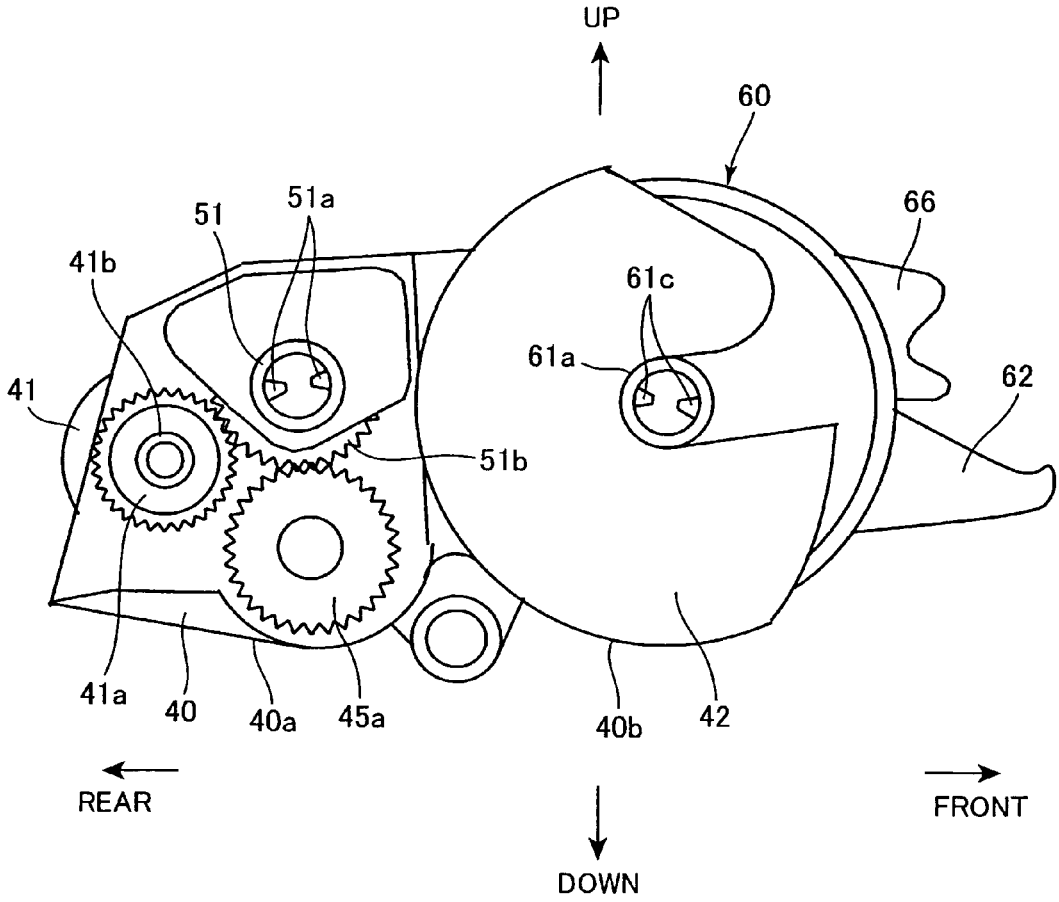
FIG. 11 is a left-side view showing the toner cartridge and the development cartridge when they are coupled with each other.

As shown in FIG. 11, a drive shaft 51 is provided on the left side of the development cartridge 40 at the developing section 40*a*. The drive shaft 51 is for receiving a drive force from a drive shaft 151, which is provided on the inner surface of the left-side wall in the main body of the laser printer 1 as shown in FIG. 10. The drive shaft 151 has a plate-shaped projection 151*a* on its axial tip end. The drive shaft 51 has a hollow cylindrical portion at its axial tip end; and a pair of projections 51*a* that are provided within the hollow cylindrical portion. The pair of projections 51*a* can engage with the plate-shaped projection 151*a* of the drive shaft 51. Thus, the drive shaft 151 can be fitted in the drive shaft 51. The drive shafts 51 and 151 constitute a so-called drive coupling.

As shown in FIG. 11, a gear 51*b* is fixedly mounted on the drive shaft 51. The gear 51*b* is located on the outer side of the left-side wall of the development cartridge 40 at the developing section 40*a*. The gear 51*b* rotates integrally with the drive shaft 51.

A rotational shaft 41*b* of the developing roller 41 and a rotational shaft of the toner-supplying roller 45 protrude outwardly from the left-side wall of the development cartridge 40. A gear 41*a* is fixed on the left-side end of the rotational shaft 41*b*, and rotates integrally with the developing roller 41. A gear 45*a* is fixed on the left-side end of the rotational shaft of the toner-supplying roller 45, and rotates integrally with the toner-supplying roller 45. Thus, the gears 41*a* and 45*a* are located on the outer side of the left-side wall of the development cartridge 40 at the developing section 40*a*. The gear 51*b* is in engagement with both of the gear 41*a* and the gear 45*a*.

Figure 12A:
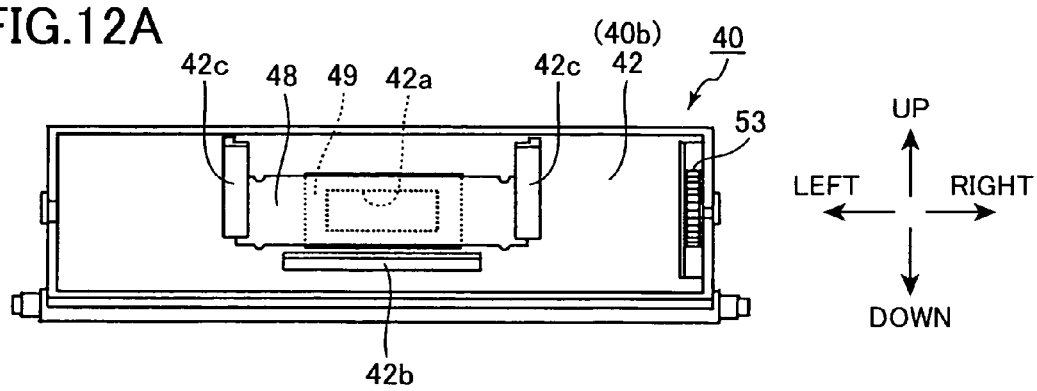
FIG. 12A is a front view of a toner-cartridge holder in the development cartridge as viewed from the toner cartridge side when the toner cartridge is disconnected from the development cartridge.
Figure 12B:
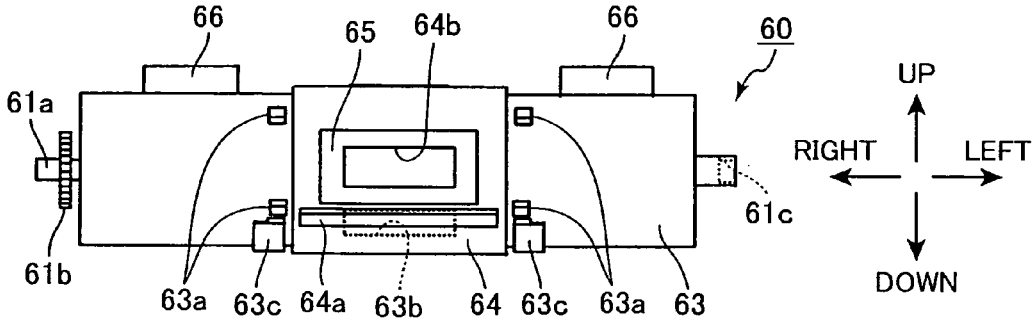
FIG. 12B is a rear view of the toner cartridge as viewed from the toner-cartridge holder side when the toner cartridge is disconnected from the development cartridge.

The toner cartridge 60 can be connected to and disconnected from the development cartridge 40. FIGS. 12A and 12B show the state where the toner cartridge 60 is disconnected from the development cartridge 40, that is, the handle 62 of the cartridge 60 has been rotated upwards to the disconnecting position as of FIG. 6. FIG. 12A shows the toner-cartridge holder 42 in the development cartridge 40, as viewed from the toner cartridge 60 side, and FIG. 12B shows the toner cartridge 60 as viewed from the toner-cartridge holder 42 side.

As shown in FIG. 12B, the toner cartridge 60 has an inner cylinder 63 and an outer cylinder 64.

The inner cylinder 63 is a longitudinal hollow cylinder-shaped casing that has a peripheral side wall and a pair of opposite end walls (right-side and left-side end walls). The inner cylinder 63 contains toner therein. The rotational shaft 61*a* of the agitator 61 extends along the central axis of the inner cylinder 63. The rotational shaft 61*a* protrudes outwardly from the pair of opposite end walls (right-side and left-side end walls) of the inner cylinder 63. A gear 61*b* is provided on the right-side end of the rotational shaft 61*a* and is therefore located on the outer side of the right-side end wall of the inner cylinder 63. The gear 61*b* rotates integrally with the rotational shaft 61*a*.

The outer cylinder 64 is coaxial with the inner cylinder 63 and surrounds the axial central part of the inner cylinder 63. The inner and outer cylinders 63 and 64 are supported by the cylindrical toner-cartridge holder 42 coaxially.

The outer cylinder 64 has an elongated projection 64*a* on its outer peripheral surface. The elongated projection 64*a* projects toward the inner peripheral surface of the toner-cartridge holder 42. The toner-cartridge holder 42 has an elongated groove 42*b* on its inner peripheral surface. The outer cylinder 64 is supported by the toner-cartridge holder 42, with the projection 64*a* being fitted in the elongated groove 42*b*. Hence, the outer cylinder 64 is fixedly secured to the toner-cartridge holder 42 and cannot rotate relative to the outer cylinder 64.

The handle 62 is formed integrally with the inner cylinder 63. The inner cylinder 63 can rotate around its central axis relative to the outer cylinder 64 when the user operates the handle 62 to move the handle 62 upwardly or downwardly.

Figure 12C:
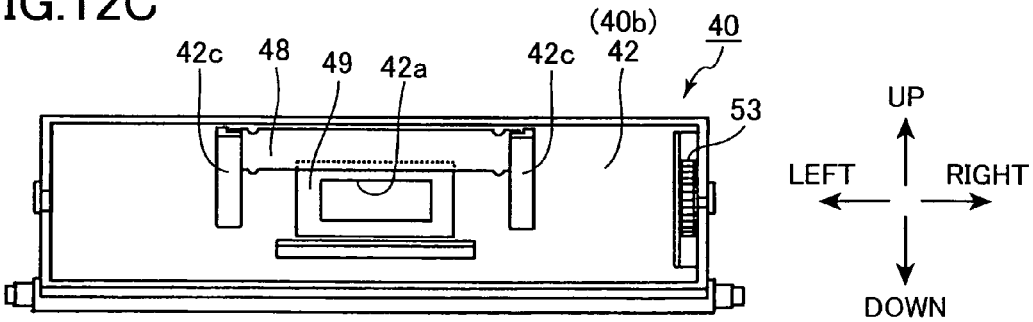
FIG. 12C is a front view of a toner-cartridge holder in the development cartridge as viewed from the toner cartridge side when the toner cartridge is coupled to the development cartridge.

As shown in FIG. 12A, a pair of rails 42*c* are provided on the inner peripheral surface of the toner-cartridge holder 42. A shutter 48 made of metal is slidably mounted on the pair of rails 42*c* at its pair of opposite ends. The shutter 48 is of a rectangular shape that is elongated in the axial direction of the toner-cartridge holder 42. The shutter 48 can move along the circumference of the cylindrical toner-cartridge holder 42, between the closing position where the shutter 48 closes the opening 42*a* as shown in FIG. 12A and the opening position where the shutter 48 is shifted upwardly from the opening 42*a* to expose the opening 42*a* as shown in FIG. 12C.

Two pairs of projections 63*a* are provided on the outer peripheral surface of the inner cylinder 63. The two pairs of projections 63*a* are separate from each other in the circumferential direction of the inner cylinder 63 as sandwiching the shutter 48 therebetween. Two projections 63*a* constituting each pair are separate from each other in the axial direction of the inner cylinder 63 and confront the two opposite longitudinal ends of the shutter 48. As the inner cylinder 63 rotates, the two pairs of projections 63*a* move the shutter 48 while holding it therebetween in the circumferential direction along the inner peripheral surface of the toner-cartridge holder 42. When the handle 62 is rotated to the disconnecting position shown in FIG. 6, the shutter 48 closes the opening 42*a* as shown in FIG. 12A.

The elongated groove 42*b* is located on the inner peripheral surface of the toner-cartridge holder 42 at a position below the shutter 48 and not overlapping the shutter 48 even when the shutter 48 is moved to its lowest position shown in FIG. 12A to completely close the opening 42*a*.

The opening 42*a* is of a rectangular shape that is elongated in the axial direction of the toner-cartridge holder 42. A sponge member 49 in a rectangular frame shape is bonded to the inner peripheral surface of the toner-cartridge holder 42 around the opening 42*a*.

A pair of engagement members 63*c* are formed on the outer peripheral surface of the inner cylinder 63 integrally with the inner cylinder 63. The pair of engagement members 63*c* are provided on the inner cylinder 63 at such locations that the engagement members 63*c* can engage with the pair of rails 42*c* when the handle 62 of the inner cylinder 63 is in a coupling position shown in FIG. 4. It is noted that each rail 42*c* has an L-shaped cross-section, while each engagement member 63*c* has a cross-sectional shape that can be engaged with the L-shaped cross-section of the corresponding rail 42*c*.

The outer cylinder 64 is formed with an opening 64*b* that has the same shape as the opening 42*a*. The opening 64*b* is provided in the outer cylinder 64 at such a position that the opening 64*b* will confront the opening 42*a* when the outer cylinder 64 is mounted in the toner-cartridge holder 42 with the elongated projection 64*a* being fitted in the elongated groove 42*b*. A sponge member 65 in the same shape with the sponge member 49 is bonded to the outer peripheral surface of the outer cylinder 64 around the opening 64*b*.

The inner cylinder 63 is formed with an opening 63*b* that has the same shape with the opening 64*b*. As shown in FIG. 12B, the openings 64*b* and 63*b* do not overlap with each other when the handle 62 is in the disconnecting position of FIG. 6. This ensures that toner will not come out from the toner cartridge 60 when the toner cartridge 60 is removed from the development cartridge 40 as shown in FIG. 7.

Figure 6:
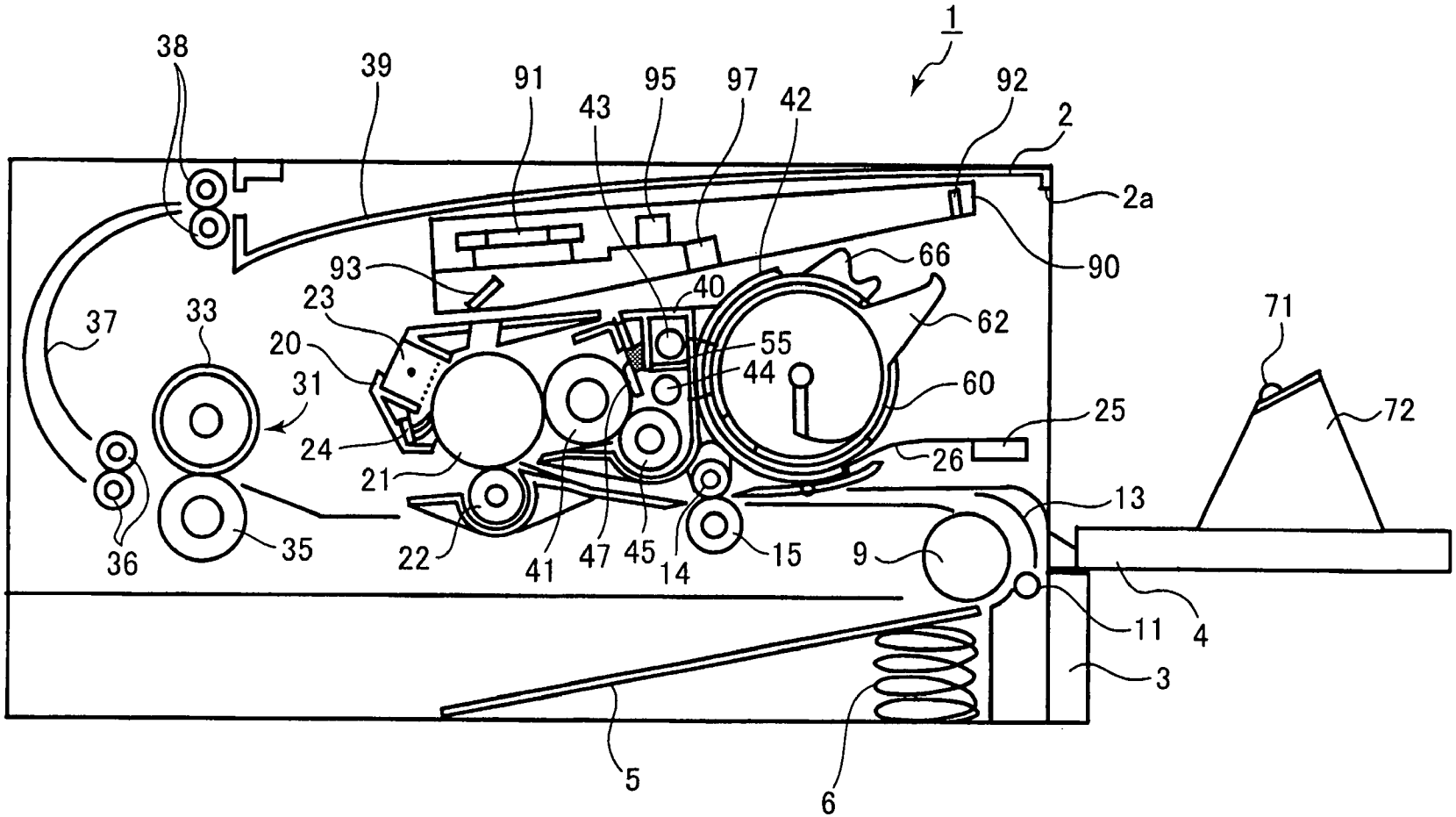
FIG. 6 is a sectional view of the laser printer, illustrating how the toner cartridge is disconnected from the development cartridge.
Figure 12D:
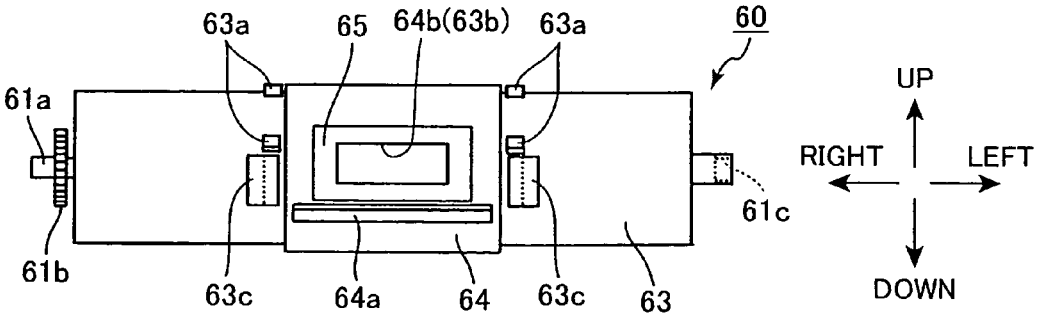
FIG. 12D is a rear view of the toner cartridge as viewed from the toner-cartridge holder side when the toner cartridge is coupled to the development cartridge.

The handle 62 of the toner cartridge 60 can be rotated from the disconnecting position of FIG. 6 downwards to the coupling position shown in FIG. 4, while maintaining the projection 64*a* to be fitted in the elongated groove 42*b*. As a result, the openings 64*b* and 63*b* become overlapping with each other as shown in FIG. 12D, and the projections 63*a* push up the shutter 48 from the opening 42*a* as shown in FIG. 12C. As a result, the inside of the inner cylinder 63 is brought into fluid communication with the inside of the developing section 40*a* of the development cartridge 40. Toner can therefore be supplied from the toner cartridge 60 to the developing section 40*a* in the development cartridge 40.

At this time, the sponge members 49 and 65 come into firm contact with each other, and the engagement members 63*c* are engaged with the rails 42*c*. Accordingly, the entire periphery of the openings 64*b* and 42*a* are tightly sealed, allowing no toner to come outside When the engagement members 63*c* are thus engaged with the rails 42*c*, the development cartridge 40 and the toner cartridge 60 are coupled to each other as shown in FIG. 4. Accordingly, the cartridges 40 and 60 can be removed and inserted, as an integral unit, from and onto the photosensitive-drum cartridge 20 as shown in FIG. 8. Thus, the cartridges 40 and 60 can be removed and inserted, as an integral unit, from and into the main body of the laser printer 1 as shown in FIG. 8.

The handle 62 may be operated to rotate the inner cylinder 63 to release the engagement members 63*c* from the rails 42*c*. Thus, the development cartridge 40 and the toner cartridge 60 can be disconnected from each other. Accordingly, only the toner cartridge 60 can be removed from the laser printer 1 as shown in FIG. 7.

Figure 13:
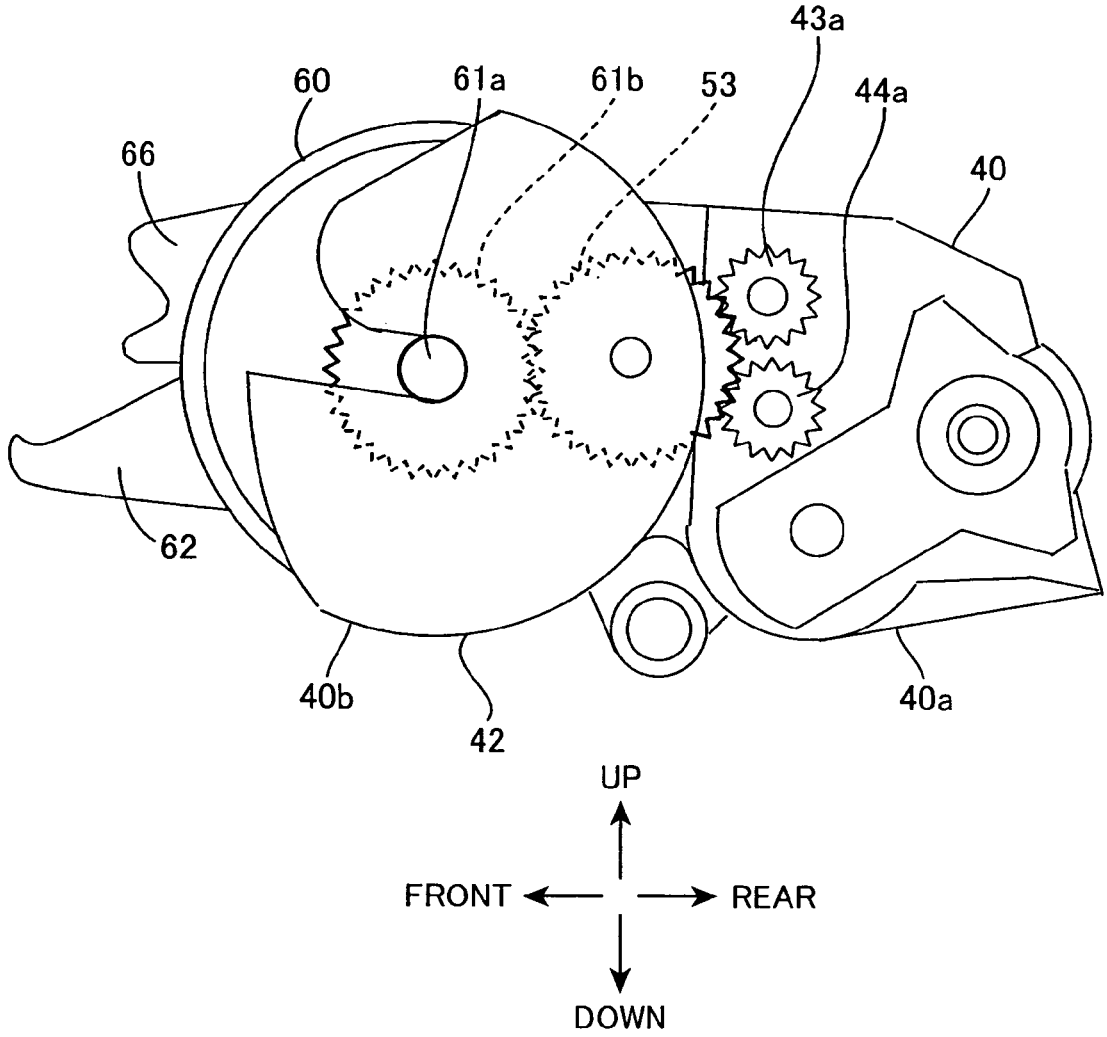
FIG. 13 is a right-side view showing the toner cartridge and the development cartridge when they are coupled with each other.

As shown in FIG. 12A and FIG. 13, a gear 53 is mounted on the inner side of the right-side end wall of the toner-cartridge holder 42. The gear 53 is engaged with the gear 61*b* when the toner cartridge 60 is set in the toner-cartridge holder 42.

As shown in FIG. 14, the upper auger roller 43 and the lower auger roller 44 protrude outwardly from the right-side wall of the development cartridge 40. As shown in FIGS. 13 and 14, gears 43*a* and 44*a* are attached to the right-side ends of the upper auger roller 43 and the lower auger roller 44, respectively. Accordingly, the gears 43*a* and 44*a* are located on the outer side of the right-side wall of the development cartridge 40. The gears 43*a* and 44*a* rotate integrally with the upper auger roller 43 and the lower auger roller 44, respectively. The gear 53 is in engagement with both of the gears 43*a* and 44*a*.

As shown in FIG. 10, a drive shaft 161 is provided on the inner surface of the left-side wall in the main body of the printer 1. The drive shaft 161 and the rotational shaft 61*a* of the agitator 61 shown in FIG. 11 constitute a so-called drive coupling. More specifically, the drive shaft 161 has a plate-shaped projection 161*a* on its axial tip end. The rotational shaft 61*a* has a hollow cylindrical portion at its left-side axial tip end, and a pair of projections 61*c* provided within the hollow cylindrical portion. The pair of projections 61*c* can engage with the plate-shaped projection 161*a* of the drive shaft 161. Thus, the drive shaft 161 can be fitted in the rotational shaft 61*a*.

The agitator 61 is rotated when a drive force is transmitted to the rotational shaft 61*a* from the drive shaft 161. The drive force is transmitted from the gear 61*b* to the gear 53, and then from the gear 53 to the gears 43*a* and 44*a*. As a result, the auger rollers 43 and 44 are rotated.

As shown in FIG. 14, the upper auger roller 43 and lower auger roller 44 have spiral blades 43*b* and 44*b*, respectively.

When the agitator 61 is driven, the lower auger roller 44 transports toner from the opening 42*a* to the left and right sides of the development cartridge 40, and the upper auger roller 43 transports toner from the left and right sides of the development cartridge 40 back to the middle part of the cartridge 40, as indicated by arrows in the figure. The toner can therefore be recovered from the right and left sides of the development cartridge 40 to the middle part thereof and returned back to the toner cartridge 60 through the opening 42*a*.

Therefore, the toner can not only be circulated in the development cartridge 40, but also be supplied back and forth between the development cartridge 40 and the toner cartridge 60. This prevents degraded toner from accumulating at a particular position to be firmly adhered thereto, thereby maintaining fluidity of toner As shown in FIG. 14, a partition wall 55 is provided in the development cartridge 40 at a location between the upper auger roller 43 and the lower auger roller 44. The partition wall 55 helps to transport toner smoothly.

Next will be described, with reference to FIG. 15, the drive system that is provided on the left-side wall in the main body of the laser printer 1 to drive the drive shafts 151 and 161.

Figure 15:
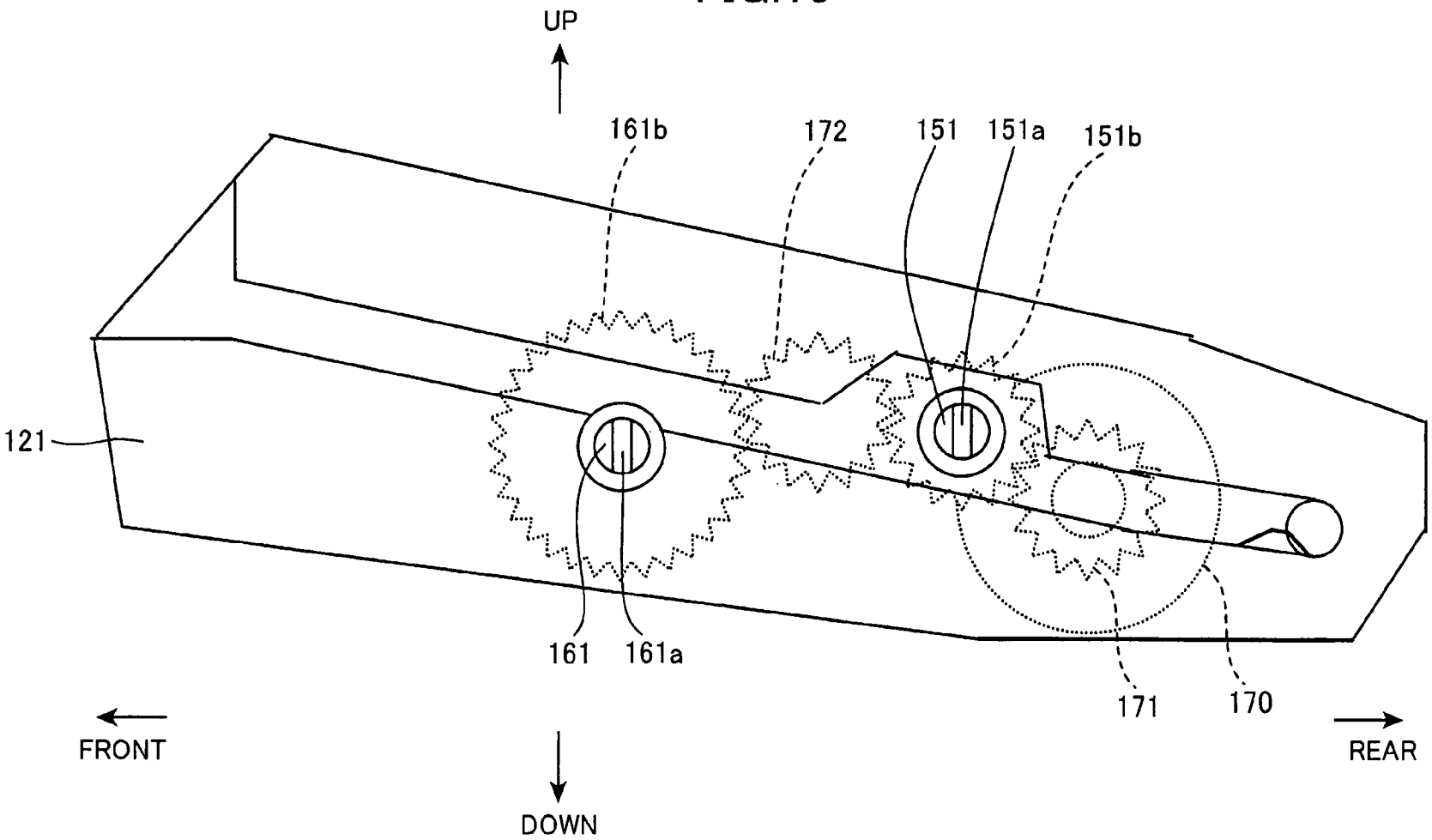
FIG. 15 is an enlarged view showing the configuration on a part of the inner surface of the left-side wall in the main body of the laser printer shown in FIG. 10.

As shown in FIG. 15, a gear 151*b*, which rotates integrally with the drive shaft 151, is in engagement with a gear 171, which rotates integrally with a shaft of an electric motor 170. Further, a gear 161*b*, which rotates integrally with the drive shaft 161, is in engagement with a gear 172, which is in engagement with the gear 151*b*. With this arrangement, when the electric motor 170 is driven to rotate, both of the drive shafts 151 and 161 rotate at prescribed gear ratios. Hence, the developing roller 41, toner-supplying roller 45, upper auger roller 43, lower auger roller 44 and agitator 61 can be driven simultaneously.

The drive shafts 151 and 161 are provided on the left-side wall in the main body of the laser printer 1 as being capable of protruding and retracting together. More specifically, the drive shafts 151 and 161 are connected to a link mechanism (not shown), and protrude when the lid 4 is closed and retract when the lid 4 is opened. When the lid 4 is opened, the drive shafts 151 and 161 are brought out of engagement from the drive shaft 51 and rotational shaft 61*a*, respectively. Thus, the photosensitive-drum cartridge 20, development cartridge 40 and toner cartridge 60 can be removed from the main body of the laser printer 1. On the other hand, when the lid 4 is closed, the drive shafts 151 and 161 are brought into engagement with the drive shaft 51 and rotational shaft 61*a*, respectively. As a result, the above-described various components can be driven.

As shown in FIGS. 11 and 12B, a pair of spring receptacles 66 are provided on the outer surface of the inner cylinder 63. The spring receptacles 66 are located slightly above the left- and right-side ends of the handle 62. Each spring receptacle 66 has a recess in the middle part in the circumferential direction of the cylinder 63. As shown in FIG. 2, a pair of pushing members 71 project from the rear surface of the lid 4. Each pushing member 71 is urged in its protruding direction by a spring (not shown) that is installed in the pushing member 71. The spring receptacles 66 receive the pushing force from the pushing members 71 when the lid 4 is closed. The pushing force reliably holds the cartridges 20, 40 and 60 in their mounting positions.

An interference member 72 also protrudes from the rear surface of the lid 4 at a location between the pair of pushing members 71. The interference member 72 interferes with the handle 62 unless the handle 62 is placed at the coupling position shown in FIG. 4. Hence, the lid 4 cannot be closed until the handle 62 is properly placed at the coupling position.

As described above, the gear 61*b* will not be engaged with the gear 53 once the toner cartridge 60 is disconnected from the development cartridge 40. Therefore, no drive force will be transmitted to the upper auger roller 43 or the lower auger roller 44. As long as the toner cartridge 60 remains disconnected from the development cartridge 40, the upper auger roller 43 or the lower auger roller 44 will not rotate. This reliably prevents the toner from overflowing the development cartridge 40. Only when the toner cartridge 60 is mounted on the development cartridge 40, the gear 61*b* will be engaged with the gear 53 and drive force will be transmitted to the auger rollers 43 and 44.

In the above description, the drive shaft 51 can transmit a drive force, driving the developing roller 41 and the toner-supplying roller 45, even when the toner cartridge 60 remains disconnected from the development cartridge 40. Thus, both rollers 41 and 45 can be driven to perform various tests for evaluating the performance of the laser printer 1, without the necessity of coupling the toner cartridge 60 to the development cartridge 40. In this case also, the upper auger roller 43 or the lower auger roller 44 is not driven. This reliably prevents the toner from overflowing the development cartridge 40.

The drive force for the auger rollers 43 and 44 is inputted from the main body of the laser printer 1 directly to the toner cartridge 60 via the coupling between the drive shafts 61 and 161. This shortens the force-transmitting path, which in turn helps to reduce the loss of the drive force.

The drive force for the developing roller 41 and the toner-supplying roller 45 is inputted from the main body of the laser printer 1 directly to the development cartridge 40 via the coupling between the drive shafts 51 and 151. Accordingly, when the toner cartridge 60 is mounted in the development cartridge 40, the developing roller 41 and the toner-supplying roller 45 can be controlled and driven independently from the auger rollers 43 and 44.

The auger roller 44 supplies toner from the toner cartridge 60 to the development cartridge 40, and the auger roller 43 recovers toner from the development cartridge 40 to the toner cartridge 60. Toner can be circulated with a simple structure. This serves to lower the manufacturing cost of the laser printer 1.

The left-side tip end of the rotational shaft 61*a* is coupled to the drive shaft 161, thereby receiving drive force from the drive shaft 161. The gear 61*b* provided on the right-side tip end of the rotational shaft 61*a* and rotating integrally with the rotational shaft 61*a* serves to output the drive force to the auger rollers 43 and 44. The agitator 61 rotates integrally with the rotational shaft 61*a*. Thus, output of the drive force to the auger rollers 43 and 44 is interlocked with the rotation of the agitator 61. Accordingly, control of the laser printer 1 is simplified.

The left-side tip end of the rotational shaft 61*a* couples with the drive shaft 161 to receive the drive force, while the gear 61*b* is provided on the right-side tip end of the rotational shaft 61*a* to output the drive force to the auger rollers 43 and 44. Thus, the portion receiving the drive force and the portion outputting the drive force are provided on the opposite sides of the toner cartridge 60. It is possible to easily design the driving system, such as the gear arrangement, that is located near to the driving-force inputting portion and the driving-force outputting portion. It is possible to easily make compact the toner cartridge 60, the development cartridge 40, and the laser printer 1.

More specifically, in the development cartridge 40, the developing roller 41 and the auger rollers 43 and 44 have to be arranged close to each other Because the toner-supplying roller 45 has to be further arranged in the development cartridge 40, one drive mechanism is provided on one side (left side) of the development cartridge 40 to drive the developing roller 41 and the toner-supplying roller 45 and another drive mechanism is provided on the other side (right side) of the development cartridge 40 to drive the auger rollers 43 and 44. Then, a drive force is transmitted via the toner cartridge 60 (rotational shaft 61*a*) from one side (left side) of the toner cartridge 60 to the other side (right side) thereof. Thus, all of the developing roller 41, the supplying roller 45, and the auger rollers 43 and 44 can be driven by the single motor 170. It is unnecessary to mount two motors each on one side of the development cartridge 40. It is possible to make compact the laser printer 1.

It is noted that the drive shafts 151 and 161 may be driven independently from each other. For example, two motors may be provided to drive the shafts 151 and 161, independently.

The development cartridge 40 can be replaced by a new one when the developing roller 41 is found degraded excessively. This improves maintenance efficiency. Similarly, the photosensitive-drum cartridge 20 can be replaced by a new one if the photosensitive drum 21 is found degraded. This also improves maintenance efficiency.

As described above, when mounting the toner cartridge 60 in the toner-cartridge holder 42 of the development cartridge 40, the toner cartridge 60 is first mounted in the toner-cartridge holder 42. As a result, the inner and outer cylinders 63 and 64 of the toner cartridge 60 are located coaxially with the cylindrical toner-cartridge holder 42, and the projection 64*a* of the outer cylinder 64 is fitted in the elongated groove 42*b*. At this time, the gear 61*b* is brought into engagement with the gear 53. Then, the inner cylinder 63 is rotated about its central axis relative to the outer cylinder 64 so that the toner cartridge 60 is completely mounted in the development cartridge 40. In other words, the inner cylinder 63 is rotated about its central axis relative to the outer cylinder 64 until the engagement members 63*c* are brought into engagement with the rails 42*c* and the inside of the inner cylinder 63 is brought into fluid communication with the inside of the developing section 40*a* of the development cartridge 40. After the toner cartridge 60 is completely mounted in the development cartridge 40, the drive force is inputted from the drive shaft 161 to the drive shaft 61*a*. As a result, the agitator 6i rotates, and the drive force is properly transmitted from the rotational shaft 61 of the agitator 60 via the gear 61*b* to the auger rollers 43*a* and 44. Because the rotational axis of the gear 61*b* and the rotational axis of the agitator 61 (rotational shaft 61*a*) coincide with each other and extend along the central axis of the inner cylinder 63, it is possible to easily mount the toner cartridge 60 to the development cartridge 40. It is ensured that the drive force is properly transmitted from the agitator 60 to the auger rollers 43 and 44.

<Modification>

Figure 16:
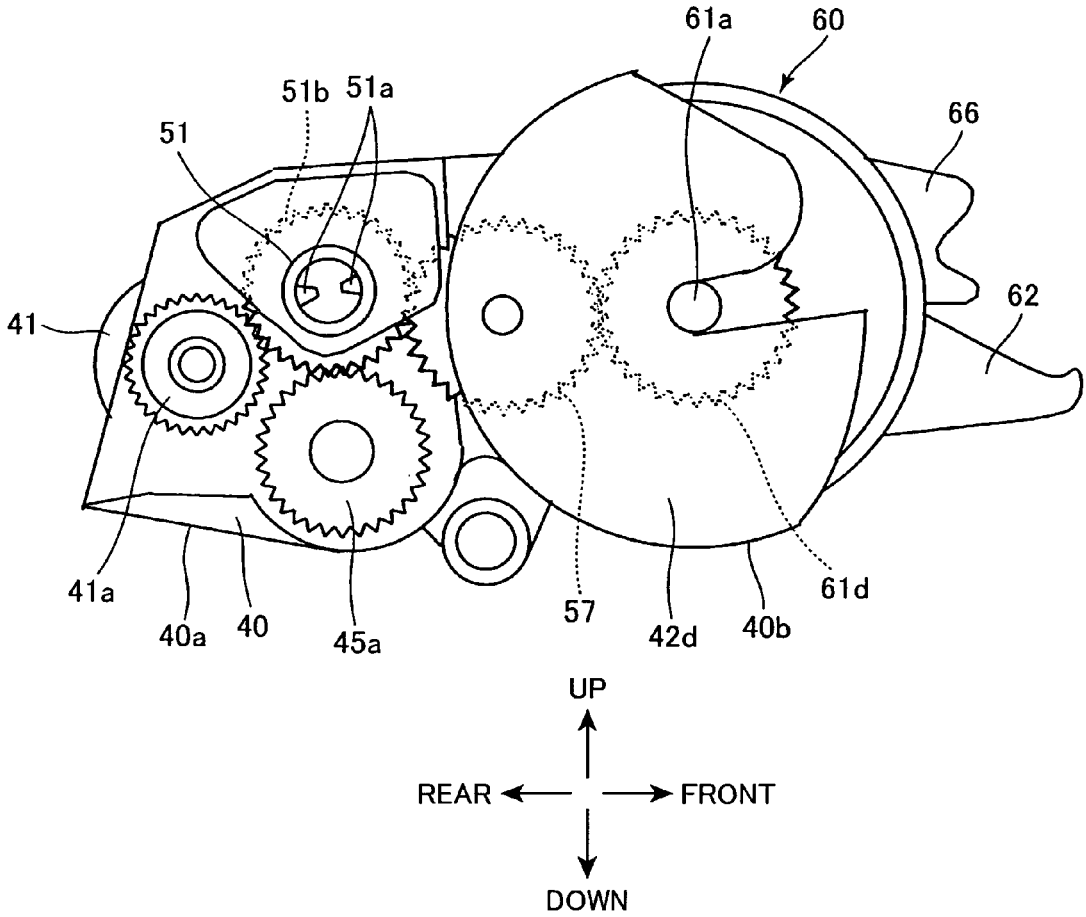
FIG. 16 is a left-side view showing the configuration of the toner cartridge and the development cartridge according to an additional aspect.

The system for driving the development cartridge 40 and toner cartridge 60 may be configured as shown in FIG. 16. In this case, the main body of the laser printer 1 may have the drive shaft 151 only. The drive shaft 161 may be omitted from the main body of the laser printer 1.

The system of this modification is the same as the above-described system except for the following points:

A gear 57 is provided on the inner surface of the left-side wall of the toner-cartridge holder 42. The left-side tip end of the rotational shaft 61*a* has no configuration that constitutes the above-described drive coupling. Instead, a gear 61*d* is integrally formed with the rotational shaft 61*a* at the left-side tip end thereof. The gear 61*d* is located on the outer side of the left-side end wall of the inner cylinder 63. The gear 57 is in engagement with the gear 51*b*. The gear 61*d* is in engagement with the gear 57 when the toner cartridge 60 is mounted in the development cartridge 40.

It is noted that the development cartridge 40 and toner cartridge 60 according to this modification have the same configuration as that described above with reference to FIG. 13.

In this modification, when a drive force is transmitted from the drive shaft 151 on the main body of the laser printer 1 to the drive shaft 51, the drive force is transmitted to the developing roller 41 and the toner-supplying roller 45 via the gears 41*a* and 45*a*, respectively. The drive force transmitted to the drive shaft 51 is transmitted also to the gear 57. The drive force is transmitted from the gear 57 further to the rotational shaft 61*a* via the gear 61*d*. As a result, the agitator 61 is driven to rotate. Further, the drive force is transmitted from the gear 61*b* to both the upper auger roller 43 and the lower auger roller 44, through the gears 53, 43*a* and 44*a*. The upper auger roller 43 and the lower auger roller 44 are thereby rotated.

In this modification, the developing roller 41 and the toner-supplying roller 45, upper auger roller 43, lower auger roller 44, and agitator 61 can be rotated, merely by transmitting the drive force to the drive shaft 51 from the drive shaft 151. Also in this modification, the gear 61*b* is not engaged with the gear 53 when the toner cartridge 60 is disconnected from the development cartridge 40. Hence, the drive force is not transmitted to the upper auger roller 43 or the lower auger roller 44 (see FIG. 13). This modification can therefore achieve the same advantages as described above.

<Another Modification>

The system for driving the development cartridge 40 and toner cartridge 60 may be configured as shown in FIGS. 17A-17D. In this case, the main body of the laser printer 1 may have the drive shaft 161 only. The drive shaft 151 may be omitted from the main body of the laser printer 1.

Figure 17A:
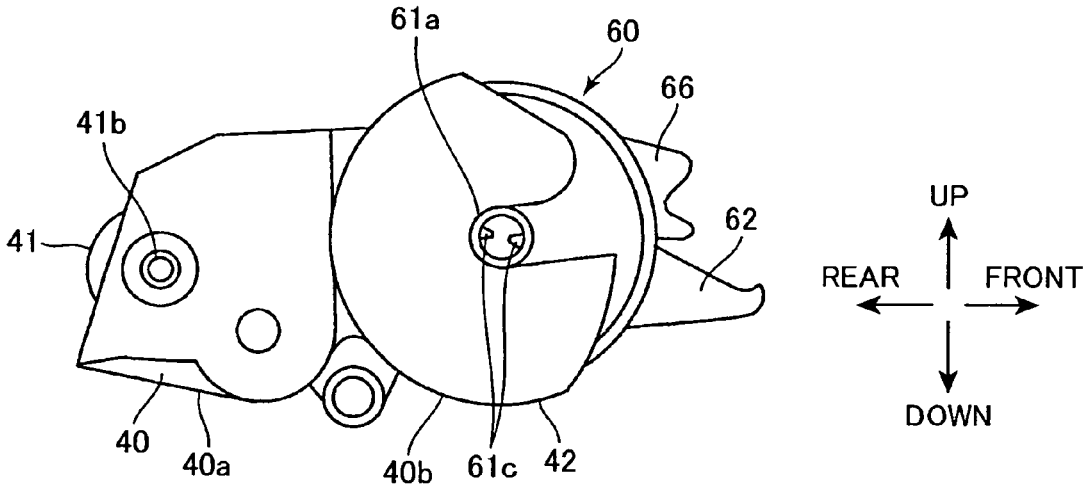
FIG. 17A is a left-side view showing the configuration of the toner cartridge and the development cartridge according to another additional aspect.
Figure 17B:
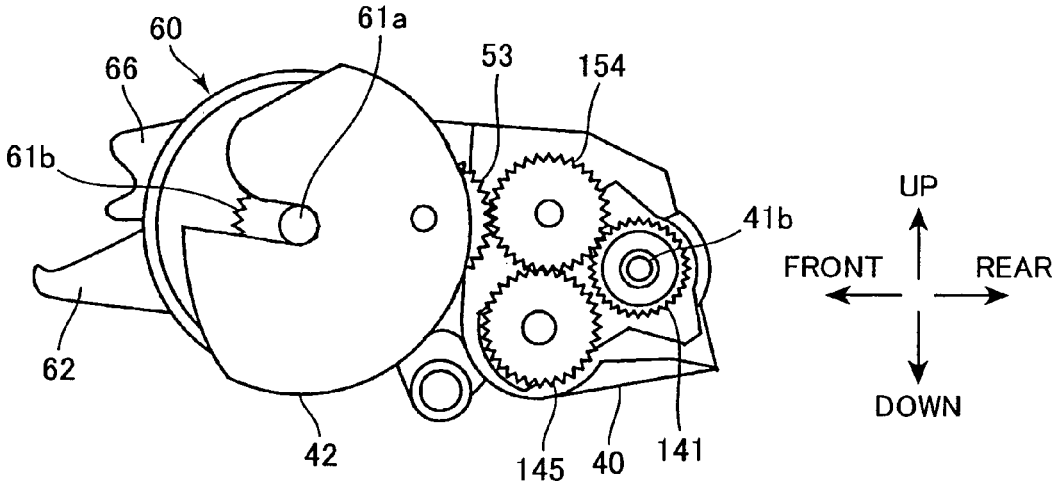
FIG. 17B is a right-side view showing the toner cartridge and the development cartridge according to the other additional aspect.

Except for the following points, the system of this modification is the same as the system described above with reference to FIGS. 1-15:

In this modification, as shown in FIG. 17A, no drive shaft 51 is provided on the left side of the development cartridge 40. No gear 41*a* is provided on the left-side end of the rotational shaft 41*b*, and no gear 45*a* is provided on the left-side end of the rotational shaft of the toner-supplying roller 45. As shown in FIG. 17D, no auger roller 43 or 44 is provided in the development cartridge 40.

Figure 17C:
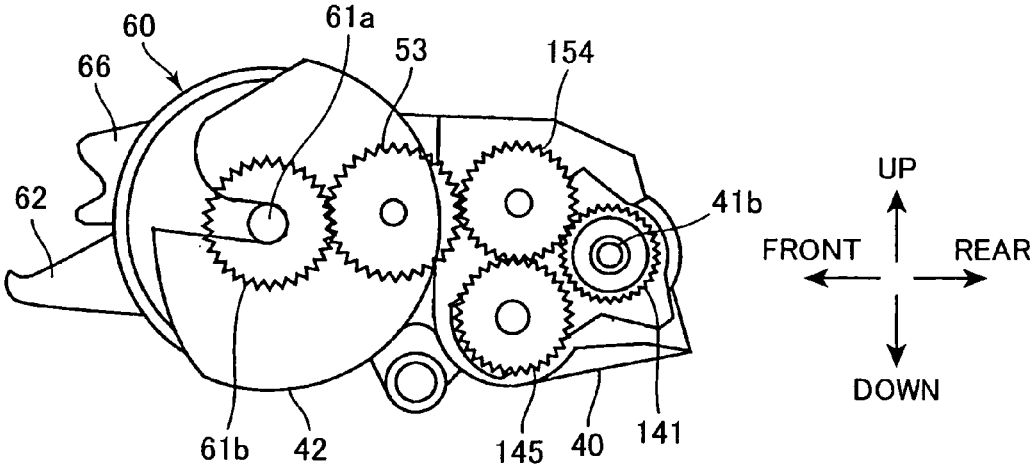
FIG. 17C is a right-side view showing the toner cartridge and the development cartridge according to the other additional aspect, showing some gears that are hidden, not indicated in FIG. 17B.
Figure 17D:
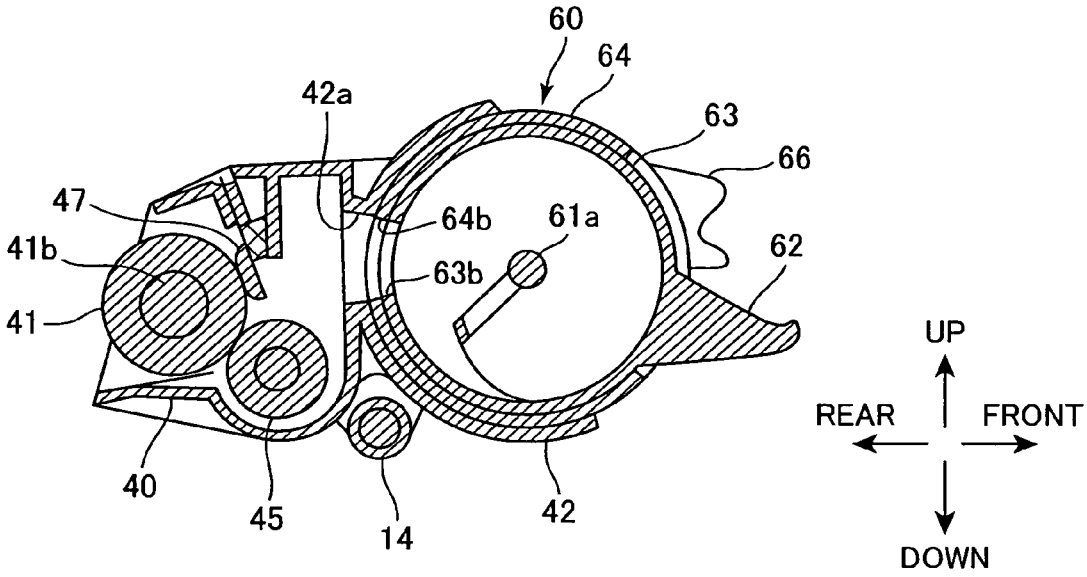
FIG. 17D is a sectional view illustrating the inner structures of the toner cartridge and development cartridge according to the other additional aspect.

Instead, as shown in FIG. 17C, an additional gear 154 is provided on the outer side of the right-side wall of the development cartridge 40. The gear 53 is in engagement with the additional gear 154.

A gear 141 is fixed on the right-side end of the rotational shaft 41*b*, and rotates integrally with the developing roller 41. A gear 145 is fixed on the right-side end of the rotational shaft of the toner-supplying roller 45, and rotates integrally with the toner-supplying roller 45. The gears 141 and 145 are in engagement with the additional gear 154.

The agitator 61 is rotated when a drive force is transmitted to the rotational shaft 61*a* from the drive shaft 161. The drive force is transmitted from the gear 61*b* via the gears 53 and 154 to the gears 141 and 145. As a result, the developing roller 41 and the toner-supplying roller 45 are rotated.

In this modification, the developing roller 41 and the toner-supplying roller 45, and agitator 61 can be rotated, merely by transmitting the drive force to the drive shaft 61*a* from the drive shaft 161. Also in this modification, the gear 61*b* is not engaged with the gear 53 when the toner cartridge 60 is disconnected from the development cartridge 40. Hence, the drive force is not transmitted to the developing roller 41 or the toner-supplying roller 45. This modification can ensure that the developing roller 41 and the toner-supplying roller 45 are driven to rotate only when the toner cartridge 60 is mounted in the development cartridge 40.

While the invention has been described in detail with reference to the above aspects thereof, it would be apparent to those skilled in the art that various changes and modifications may be made therein without departing from the spirit of the invention.

The laser printer 1 can be modified to various image forming apparatuses of electronic photographic type, such as copying apparatuses, facsimile apparatuses and color laser printers. The photosensitive drum 21 may be modified into a photoelectric belt. A non-photosensitive electrostatic latent image bearing body may be provided instead of the photosensitive drum 21. An intermediate transfer belt may be used to transfer toner images onto a recording medium.

In the above description, since the photosensitive-drum cartridge 20 and the development cartridge 40 are detachably mounted in the main body of the laser printer 1, they can be replaced by new ones when necessary. This facilitates easy maintenance of the laser printer 1. However., the photosensitive-drum cartridge 20 and the development cartridge 40 may be fixedly secured in the main body of the laser printer 1.

In the above description, the photosensitive-drum cartridge 20 and the development cartridge 40 can be disconnected from each other. This facilitates easy maintenance of the photosensitive-drum cartridge 20 and the development cartridge 40. However, the photosensitive-drum cartridge 20 and the development cartridge 40 may be formed integrally with each other into a process cartridge. The photosensitive-drum cartridge 20 and the development cartridge 40 may not be disconnected from each other.

What is claimed is:

1. An image forming apparatus, comprising:

an electrostatic latent image bearing member that has an electrostatic latent image formed thereon;

a toner cartridge that contains toner and comprises a first side and a second side opposite the first side;

a developing member that supplies the toner from the toner cartridge onto the electrostatic latent image bearing member, thereby developing the electrostatic latent image into a toner image;

a transfer member that transfers the toner image from the electrostatic latent image bearing member to a recording medium;

a developing device, to which the toner cartridge is removably coupled and which incorporates the developing member;

a toner-circulating member that is incorporated in the developing device and that circulates toner between the developing device and the toner cartridge, wherein the toner-circulating member is positioned to be attached to the developing device when the toner cartridge is removed from the developing device;

a drive-force output unit that is provided in the toner cartridge and that is configured to output to the developing device a drive force for driving the toner-circulating member;

a drive-force input unit, to which the drive force to be outputted from the drive-force output unit is inputted; and a circulating-member driving unit that is provided in the developing device and that is configured to drive the toner-circulating member upon receiving the drive force outputted from the drive-force output unit while the toner cartridge is being coupled to the developing device, wherein the drive-force input unit is provided on the first side of the toner cartridge and the drive-force output unit is provided on the second side of the toner cartridge.

2. The image forming apparatus according to claim 1, further comprising a housing, the developing device being detachably mounted in the housing.

3. The image forming apparatus according to claim 1, further comprising a housing, the electrostatic latent image bearing member being detachably mounted in the housing.

4. The image forming apparatus according to claim 1, wherein the developing device further comprises a drive-force transmitting member that transmits the drive force to the developing member from a main body of the image forming apparatus irrespective of whether or not the toner cartridge is coupled to the developing device.

5. The image forming apparatus according to claim 4, wherein the drive-force transmitting member transmits the drive force to both of the developing member and the drive-force input unit while the toner cartridge remains coupled to the developing device.

6. The image forming apparatus according to claim 4, wherein the drive-force input unit receives the drive force from the main body of the image forming apparatus.

7. The image forming apparatus according to claim 6, wherein the drive-force input unit receives the drive force from the main body of the image forming apparatus, independently from the drive-force transmitting member.

8. The image forming apparatus according to claim 1, wherein the toner-circulating member comprises a toner-supplying auger member that supplies toner from the toner cartridge to the developing device, and a toner-recovering auger member that recovers toner from the developing device to the toner cartridge.

9. The image forming apparatus according to claim 1, further comprising:

an apparatus housing; and an apparatus-side drive-force output unit that is provided in the apparatus housing and that outputs a drive force, wherein the drive-force input unit of the toner cartridge is configured to receive the drive force from the apparatus-side drive-force output unit.

10. A toner cartridge, which is capable of being removably coupled to a development cartridge that includes a developing member, the toner cartridge comprising:

a casing defining a toner containing portion that contains toner, wherein the casing comprises a first side and a second side opposite the first side;

a drive-force input unit which is provided on the casing and which is configured to receive a drive force from outside of the casing;

an agitating member that agitates the toner contained in the toner containing portion by receiving the drive force from the drive force input unit; and a drive-force output unit that is provided on the casing and that is configured to receive the driving force from the agitating member and to output the drive force to the outside of the casing, wherein the agitating member, the drive-force input unit, and the drive-force output unit operate as being interlocked with one another, and wherein the drive-force input unit is located on an outer surface of the casing at the first side thereof, and the drive-force output unit is located on the outer surface of the casing at the second side thereof.

11. The toner cartridge according to claim 10, wherein the drive-force output unit is configured to output the drive force to the development cartridge.

12. The toner cartridge according to claim 10, wherein the drive-force output unit includes an output gear that communicates with a gear provided in the development cartridge when the toner cartridge is coupled to the development cartridge.

13. The toner cartridge according to claim 12, wherein the drive-force input unit includes a coupling gear provided in the first side, the output gear being provided in the second side.

14. The toner cartridge according to claim 10, wherein the drive-force input unit is configured that the drive force is inputted from the development cartridge when the toner cartridge is coupled to the development cartridge.

15. The toner cartridge according to claim 10, wherein a drive force is inputted to the drive-force input unit from an image forming apparatus when the toner cartridge is mounted in the image forming apparatus.

16. The toner cartridge according to claim 15, wherein the drive force is communicable with the development cartridge when the toner cartridge is coupled with the development cartridge.

17. The toner cartridge according to claim 10, wherein the drive-force output unit includes an output gear rotatable about an axis, and the agitating member is supported by the casing, the agitating member being rotatable about the axis.

18. The toner cartridge according to claim 17, wherein the output gear communicates with a gear provided in the development cartridge when the toner cartridge is coupled to the development cartridge.

19. A development cartridge which is capable of being detachably mounted in an image forming apparatus, the development cartridge comprising:

a casing;

a developing member that is mounted in the casing and that supplies toner from a toner cartridge to an electrostatic latent image bearing member, on which an electrostatic latent image is formed, thereby developing the electrostatic latent image into a toner image;

a toner-circulating member that circulates toner, wherein the toner-circulating member is positioned to be attached to the development cartridge when the toner cartridge is separated from the development cartridge; and a circulating-member driving unit that is configured to drive the toner-circulating member upon receiving a drive force from the toner cartridge.

20. A process cartridge which is capable of being detachably mounted in an image forming apparatus, the process cartridge comprising:

a casing;

an electrostatic latent image bearing member provided in the casing, an electrostatic latent image being formed on the electrostatic latent image bearing member;

a developing member that is mounted in the casing and that supplies toner from a toner cartridge to the electrostatic latent image bearing member, thereby developing the electrostatic latent image formed on the electrostatic latent image bearing member into a toner image;

a toner-circulating member that circulates toner between the casing and the toner cartridge, wherein the toner-circulating member is positioned in the casing when the toner cartridge is separated from the casing; and a circulating-member driving unit that is configured to drive the toner-circulating member upon receiving a drive force transmitted from the toner cartridge.

21. An image forming apparatus, comprising:

an electrostatic latent image bearing member that has an electrostatic latent image formed thereon;

a toner cartridge that contains toner;

a developing member that supplies the toner from the toner cartridge onto the electrostatic latent image bearing member, thereby developing the electrostatic latent image into a toner image;

a transfer member that transfers the toner image from the electrostatic latent image bearing member to a recording medium;

a developing device, to which the toner cartridge is removably coupled and which incorporates the developing member;

a drive-force output unit that is provided in the toner cartridge and that is configured to output a drive force to the developing device while the toner cartridge is being coupled to the developing device;

a toner-circulating member that is incorporated in the developing device and that circulates toner, wherein the toner circulating member is positioned to be attached to the developing device when the toner cartridge is removed from the developing device; and a circulating-member driving unit that is provided in the developing device and that is configured to drive the toner-circulating member upon receiving a drive force outputted from the driving-force output unit while the toner cartridge is being coupled to the developing device.

22. A development cartridge which is capable of being detachably mounted in an image forming apparatus, the development cartridge comprising:

a casing;

a developing member that is mounted in the casing and that supplies toner from a toner cartridge to an electrostatic latent image bearing member, on which an electrostatic latent image is formed, thereby developing the electrostatic latent image into a toner image;

a drive-force receiving unit that is configured to receive a drive force from the toner cartridge while the toner cartridge is being coupled to the casing;

a toner-circulating member that circulates toner, wherein the toner circulating member is positioned in the casing when the toner cartridge is removed from the casing; and a circulating-member driving unit that is configured to drive the toner-circulating member upon receiving a drive force from the driving force receiving unit.

23. A process cartridge which is capable of being detachably mounted in an image forming apparatus, the process cartridge comprising:

a casing;

an electrostatic latent image bearing member provided in the casing, an electrostatic latent image being formed on the electrostatic latent image bearing member;

a developing member that is mounted in the casing and that supplies toner from a toner cartridge to the electrostatic latent image bearing member, thereby developing the electrostatic latent image formed on the electrostatic latent image bearing member into a toner image;

a drive-force receiving unit that is configured to receive a drive force transmitted from the toner cartridge while the toner cartridge is being coupled to the casing;

a toner-circulating member that is provided in the casing and that circulates toner between the casing and the toner cartridge, wherein the toner circulating member is positioned in the casing when the toner cartridge is removed from the casing; and a circulating-member driving unit that is configured to drive the toner-circulating member upon receiving a drive force from the driving force receiving unit.

* * * * *